US009528354B2

(12) United States Patent
Loiseau et al.

(10) Patent No.: US 9,528,354 B2
(45) Date of Patent: Dec. 27, 2016

(54) DOWNHOLE TOOL POSITIONING SYSTEM AND METHOD

(71) Applicant: Schlumberger Technology Corporation, Sugar Land, TX (US)

(72) Inventors: Anthony Loiseau, Sugar Land, TX (US); James Ernest Brown, Fort Collins, CO (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 542 days.

(21) Appl. No.: 13/803,708

(22) Filed: Mar. 14, 2013

(65) Prior Publication Data

US 2014/0131045 A1 May 15, 2014

Related U.S. Application Data

(60) Provisional application No. 61/726,340, filed on Nov. 14, 2012.

(51) Int. Cl.

| | |
|---|---|
| ***E21B 23/00*** | (2006.01) |
| ***E21B 43/119*** | (2006.01) |
| ***E21B 23/04*** | (2006.01) |
| ***E21B 33/14*** | (2006.01) |
| ***E21B 43/267*** | (2006.01) |
| ***E21B 4/18*** | (2006.01) |
| ***E21B 21/08*** | (2006.01) |

(52) U.S. Cl.

CPC ..... *E21B 43/119* (2013.01); *E21B 4/18* (2013.01); *E21B 21/08* (2013.01); *E21B 23/04* (2013.01); *E21B 33/14* (2013.01); *E21B 43/267* (2013.01)

(58) Field of Classification Search

CPC ..... E21B 23/04; E21B 43/19; E21B 21/08; E21B 4/18; E21B 43/267; E21B 33/14; E21B 43/119

See application file for complete search history.

(56) References Cited

U.S. PATENT DOCUMENTS

| | | | |
|---|---|---|---|
| 2,193,775 | A | 3/1940 | Stratford |
| 2,513,944 | A | 7/1950 | Kessler |
| RE24,570 | E | 11/1958 | Mangold et al. |
| 2,905,245 | A | 9/1959 | De Priester |

(Continued)

FOREIGN PATENT DOCUMENTS

| | | |
|---|---|---|
| CA | 2710988 | 7/2009 |
| EP | 1236701 | 9/2002 |

(Continued)

OTHER PUBLICATIONS

Kirk-Othmer Encyclopedia of Chemical Technology, vol. 17, pp. 143-167 (1982), "Petroleum (Drilling Fluids)".

(Continued)

*Primary Examiner* — Yong-Suk (Philip) Ro

(74) *Attorney, Agent, or Firm* — Michael L. Flynn; Tim Currington

(57) ABSTRACT

Downhole tool positioning systems and methods are disclosed which employ buoyancy-mediated tool displacement wherein the density of the tool or string connected to it, and the treatment fluid are matched to facilitate hydraulic translation of the tool in a deviated borehole or lateral with or without a mechanical translation device.

20 Claims, 9 Drawing Sheets

(56) References Cited

U.S. PATENT DOCUMENTS 3,362,475 A 1/1968 Huitt
3,434,540 A 3/1969 Stein
3,526,280 A * 9/1970 Aulick ..... 166/285
3,675,717 A 7/1972 Goins, Jr.
3,887,474 A 6/1975 Senfe et al.
3,937,283 A 2/1976 Blauer et al.
4,051,900 A 10/1977 Hankins
4,384,616 A * 5/1983 Dellinger ..... 166/376
4,387,769 A 6/1983 Erbstoesser et al.
4,506,734 A 3/1985 Nolte
4,526,695 A 7/1985 Erbstoesser et al.
4,606,407 A 8/1986 Shu
4,652,257 A 3/1987 Chang
4,665,988 A 5/1987 Murphey et al.
4,670,166 A 6/1987 McDougall et al.
4,718,490 A 1/1988 Uhri
4,738,897 A 4/1988 McDougall et al.
4,785,884 A 11/1988 Armbruster
4,848,467 A 7/1989 Cantu et al.
4,867,241 A 9/1989 Strubhar
4,883,124 A 11/1989 Jennings, Jr.
4,917,185 A 4/1990 Jennings, Jr. et al.
4,951,751 A 8/1990 Jennings, Jr.
4,957,165 A 9/1990 Cantu et al.
4,968,353 A 11/1990 Kawasaki et al.
4,968,354 A 11/1990 Nishiura et al.
4,977,961 A 12/1990 Avasthi
4,986,355 A 1/1991 Casad et al.
5,036,920 A 8/1991 Cornette et al.
5,095,987 A 3/1992 Weaver et al.
5,117,915 A * 6/1992 Mueller et al. ..... 166/381
5,161,618 A 11/1992 Jones et al.
5,188,837 A 2/1993 Domb
5,238,067 A 8/1993 Jennings, Jr.
5,325,921 A 7/1994 Johnson et al.
5,330,005 A 7/1994 Card et al.
5,332,037 A 7/1994 Schmidt et al.
5,333,689 A 8/1994 Jones et al.
5,415,228 A 5/1995 Price et al.
5,439,055 A 8/1995 Card et al.
5,492,178 A 2/1996 Nguyen et al.
5,501,274 A 3/1996 Nguyen et al.
5,501,275 A 3/1996 Card et al.
5,507,342 A 4/1996 Copeland et al.
5,518,996 A 5/1996 Maroy et al.
5,551,516 A 9/1996 Norman et al.
5,629,271 A 5/1997 Dobson, Jr. et al.
5,713,416 A 2/1998 Chatterji et al.
5,741,758 A 4/1998 Pakulski
5,893,416 A 4/1999 Read
5,905,468 A 5/1999 Ikawa et al.
5,908,073 A 6/1999 Nguyen et al.
5,922,652 A 7/1999 Kowalski et al.
5,934,376 A 8/1999 Nguyen et al.
5,964,291 A 10/1999 Bourne et al.
5,979,557 A 11/1999 Card et al.
6,059,034 A 5/2000 Rickards et al.
6,114,410 A 9/2000 Betzold
6,156,805 A 12/2000 Smith et al.
6,172,011 B1 1/2001 Card et al.
6,209,643 B1 4/2001 Nguyen et al.
6,209,646 B1 4/2001 Reddy et al.
6,239,183 B1 5/2001 Farmer et al.
6,258,859 B1 7/2001 Dahayanake et al.
6,273,189 B1 8/2001 Gissler et al.
6,279,656 B1 8/2001 Sinclair et al.
6,302,207 B1 10/2001 Nguyen et al.
6,326,335 B1 12/2001 Kowalski et al.
6,328,105 B1 12/2001 Betzold
6,330,916 B1 12/2001 Rickards et al.
6,364,020 B1 4/2002 Crawshaw et al.
6,379,865 B1 4/2002 Mao et al.
6,380,136 B1 4/2002 Bates et al.
6,435,277 B1 8/2002 Qu et al.
6,439,309 B1 8/2002 Matherly et al.
6,443,228 B1 9/2002 Aronstam et al.
6,446,722 B2 9/2002 Nguyen et al.
6,464,009 B2 10/2002 Bland et al.
6,482,517 B1 11/2002 Anderson
6,506,710 B1 1/2003 Hoey et al.
6,543,538 B2 4/2003 Tolman et al.
6,559,245 B2 5/2003 Mao et al.
6,599,863 B1 7/2003 Palmer et al.
6,656,265 B1 12/2003 Garnier et al.
6,703,352 B2 3/2004 Dahayanake et al.
6,719,054 B2 4/2004 Cheng et al.
6,723,683 B2 4/2004 Crossman et al.
6,725,930 B2 4/2004 Boney et al.
6,742,590 B1 6/2004 Nguyen
6,776,235 B1 8/2004 England
6,818,594 B1 11/2004 Freeman et al.
6,828,280 B2 12/2004 England et al.
6,860,328 B2 3/2005 Gonzalez et al.
6,874,578 B1 4/2005 Garnier et al.
6,877,560 B2 4/2005 Nguyen et al.
6,938,693 B2 9/2005 Boney et al.
6,989,195 B2 1/2006 Anderson
7,004,255 B2 2/2006 Boney
7,028,775 B2 4/2006 Fu et al.
7,044,220 B2 5/2006 Nguyen et al.
7,044,224 B2 5/2006 Nguyen
7,049,272 B2 5/2006 Sinclair et al.
7,060,661 B2 6/2006 Dobson, Sr. et al.
7,066,260 B2 6/2006 Sullivan et al.
7,084,095 B2 8/2006 Lee et al.
7,148,184 B2 12/2006 Francini et al.
7,166,560 B2 1/2007 Still et al.
7,178,596 B2 2/2007 Blauch et al.
7,195,066 B2 3/2007 Sukup et al.
7,213,651 B2 5/2007 Brannon et al.
7,219,731 B2 5/2007 Sullivan et al.
7,237,610 B1 7/2007 Saini et al.
7,261,157 B2 8/2007 Nguyen et al.
7,265,079 B2 9/2007 Willberg et al.
7,267,170 B2 9/2007 Mang et al.
7,275,596 B2 10/2007 Willberg et al.
7,284,611 B2 10/2007 Reddy et al.
7,290,615 B2 11/2007 Christanti et al.
7,294,347 B2 11/2007 Menjoge et al.
7,303,018 B2 12/2007 Cawiezel et al.
7,373,991 B2 5/2008 Vaidya et al.
7,398,826 B2 7/2008 Hoefer et al.
7,405,183 B2 7/2008 Hanes, Jr.
7,419,937 B2 9/2008 Rimmer et al.
7,451,812 B2 11/2008 Cooper et al.
7,482,311 B2 1/2009 Willberg et al.
7,493,955 B2 2/2009 Gupta et al.
7,510,009 B2 3/2009 Cawiezel et al.
7,528,096 B2 5/2009 Brannon et al.
7,543,640 B2 6/2009 MacDougall
7,549,479 B2 * 6/2009 Biegler et al. ..... 166/381
7,559,369 B2 7/2009 Roddy et al.
7,565,929 B2 7/2009 Bustos et al.
7,581,590 B2 9/2009 Lesko et al.
7,624,802 B2 12/2009 McCrary et al.
7,644,761 B1 1/2010 Gu et al.
7,784,541 B2 8/2010 Hartman et al.
7,789,146 B2 9/2010 Panga et al.
7,806,182 B2 10/2010 Waters et al.
7,833,947 B1 11/2010 Kubala
7,923,415 B2 4/2011 Panga et al.
7,931,088 B2 4/2011 Stegemoeller et al.
7,954,548 B2 6/2011 Curimbaba et al.
7,973,991 B2 7/2011 Watanabe
8,008,234 B2 8/2011 Panga et al.
8,119,574 B2 2/2012 Panga et al.
8,167,043 B2 5/2012 Willberg et al.
8,168,570 B2 5/2012 Barron et al.
8,210,249 B2 7/2012 Panga et al.
8,227,026 B2 7/2012 McDaniel et al.
8,234,072 B2 7/2012 Smith, Jr. et al.
2002/0096322 A1 7/2002 Barrett et al.
2003/0134751 A1 7/2003 Lee et al.
2004/0060702 A1 4/2004 Kotlar et al.

(56) References Cited

U.S. PATENT DOCUMENTS

| | | | |
|---|---|---|---|
| 2004/0074646 | A1 | 4/2004 | Kotlar et al. |
| 2004/0106525 | A1 | 6/2004 | Willberg et al. |
| 2004/0152601 | A1 | 8/2004 | Still et al. |
| 2004/0209780 | A1 | 10/2004 | Harris et al. |
| 2004/0261993 | A1 | 12/2004 | Nguyen |
| 2004/0261995 | A1 | 12/2004 | Nguyen et al. |
| 2004/0261996 | A1 | 12/2004 | Munoz, Jr. et al. |
| 2005/0027499 | A1 | 2/2005 | Bourbiaux et al. |
| 2005/0103496 | A1 | 5/2005 | Todd et al. |
| 2005/0130845 | A1 | 6/2005 | Freeman et al. |
| 2005/0130848 | A1 | 6/2005 | Todd et al. |
| 2005/0161220 | A1 | 7/2005 | Todd et al. |
| 2005/0172699 | A1 | 8/2005 | Hu et al. |
| 2005/0233895 | A1 | 10/2005 | Mertens et al. |
| 2005/0241835 | A1 | 11/2005 | Burris et al. |
| 2005/0252651 | A1 | 11/2005 | Bosma et al. |
| 2005/0252659 | A1 | 11/2005 | Sullivan et al. |
| 2006/0006539 | A1 | 1/2006 | Matsui et al. |
| 2006/0048943 | A1 | 3/2006 | Parker et al. |
| 2006/0048944 | A1 | 3/2006 | van Batenburg et al. |
| 2006/0052251 | A1 | 3/2006 | Anderson et al. |
| 2006/0054324 | A1 | 3/2006 | Sullivan et al. |
| 2006/0058197 | A1 | 3/2006 | Brown et al. |
| 2006/0073980 | A1 | 4/2006 | Brannon et al. |
| 2006/0113078 | A1 | 6/2006 | Nguyen et al. |
| 2006/0124302 | A1 | 6/2006 | Gupta et al. |
| 2006/0151173 | A1 | 7/2006 | Slabaugh et al. |
| 2006/0157243 | A1 | 7/2006 | Nguyen |
| 2006/0175059 | A1 | 8/2006 | Sinclair et al. |
| 2006/0185848 | A1 | 8/2006 | Surjaatmadja et al. |
| 2006/0289160 | A1 | 12/2006 | van Batenburg et al. |
| 2007/0017675 | A1 | 1/2007 | Hammami et al. |
| 2007/0029086 | A1 | 2/2007 | East, Jr. |
| 2007/0039733 | A1 | 2/2007 | Welton et al. |
| 2007/0042912 | A1 | 2/2007 | Welton et al. |
| 2007/0044963 | A1 | 3/2007 | MacDougall |
| 2007/0238623 | A1 | 10/2007 | Saini et al. |
| 2008/0000391 | A1 | 1/2008 | Drochon |
| 2008/0000638 | A1 | 1/2008 | Burukhin et al. |
| 2008/0053657 | A1 | 3/2008 | Alary et al. |
| 2008/0066910 | A1 | 3/2008 | Alary et al. |
| 2008/0093073 | A1 | 4/2008 | Bustos et al. |
| 2008/0103065 | A1 | 5/2008 | Reddy et al. |
| 2008/0108520 | A1 | 5/2008 | Fu |
| 2008/0121395 | A1 | 5/2008 | Reddy et al. |
| 2008/0135250 | A1 | 6/2008 | Bosma et al. |
| 2008/0196896 | A1 | 8/2008 | Bustos et al. |
| 2008/0210423 | A1 | 9/2008 | Boney |
| 2008/0280788 | A1 | 11/2008 | Parris et al. |
| 2008/0280790 | A1 | 11/2008 | Mirakyan et al. |
| 2008/0314594 | A1 | 12/2008 | Still et al. |
| 2008/0318026 | A1 | 12/2008 | Dai et al. |
| 2009/0008095 | A1 | 1/2009 | Duncum et al. |
| 2009/0025394 | A1 | 1/2009 | Bonzani et al. |
| 2009/0025932 | A1 | 1/2009 | Panga et al. |
| 2009/0025934 | A1 | 1/2009 | Hartman et al. |
| 2009/0107671 | A1 | 4/2009 | Waters et al. |
| 2009/0294126 | A1 | 12/2009 | Dalrymple et al. |
| 2010/0000735 | A1 | 1/2010 | Weaver et al. |
| 2010/0087341 | A1 | 4/2010 | Alary et al. |
| 2010/0087342 | A1 | 4/2010 | Alary et al. |
| 2010/0089580 | A1 | 4/2010 | Brannon et al. |
| 2010/0126722 | A1 | 5/2010 | Cornelissen et al. |
| 2010/0200247 | A1 | 8/2010 | Dybevik et al. |
| 2010/0300688 | A1 | 12/2010 | Panga et al. |
| 2011/0005760 | A1 | 1/2011 | Hartman et al. |
| 2011/0036577 | A1 | 2/2011 | Barmatov et al. |
| 2011/0053813 | A1 | 3/2011 | Panga et al. |
| 2011/0098202 | A1 | 4/2011 | James et al. |
| 2011/0155371 | A1 | 6/2011 | Panga et al. |
| 2011/0198089 | A1 | 8/2011 | Panga et al. |
| 2011/0247812 | A1 | 10/2011 | Panga et al. |
| 2012/0000641 | A1 | 1/2012 | Panga et al. |
| 2012/0000651 | A1 | 1/2012 | Panga et al. |
| 2012/0085539 | A1* | 4/2012 | Tonnessen et al. ..... 166/298 |
| 2012/0111563 | A1 | 5/2012 | Abad et al. |
| 2012/0132421 | A1 | 5/2012 | Loiseau et al. |
| 2012/0138296 | A1 | 6/2012 | Panga et al. |
| 2012/0247764 | A1 | 10/2012 | Chen et al. |
| 2012/0305254 | A1 | 12/2012 | Chen et al. |
| 2013/0233542 | A1 | 9/2013 | Shampine et al. |
| 2013/0324444 | A1 | 12/2013 | Lesko et al. |

FOREIGN PATENT DOCUMENTS

| | | |
|---|---|---|
| EP | 2473705 | 7/2012 |
| GB | 2277543 | 11/1994 |
| RU | 2065442 | 8/1996 |
| RU | 2221130 | 1/2004 |
| RU | 2376451 | 12/2009 |
| RU | 2404359 | 11/2010 |
| RU | 2413064 | 2/2011 |
| RU | 2417243 | 4/2011 |
| WO | WO9607710 | 3/1996 |
| WO | WO9930249 | 6/1999 |
| WO | WO2004007904 | 1/2004 |
| WO | WO2004038176 | 5/2004 |
| WO | WO2006082359 | 8/2006 |
| WO | WO2009013710 | 1/2009 |
| WO | WO2009088317 | 7/2009 |
| WO | WO2009088318 | 7/2009 |
| WO | WO2009106796 | 9/2009 |
| WO | WO2009141749 | 11/2009 |
| WO | WO2010117547 | 10/2010 |
| WO | WO2011024100 | 3/2011 |
| WO | 2011050046 | 4/2011 |
| WO | WO2011129937 | 10/2011 |
| WO | WO2011143055 | 11/2011 |
| WO | WO2012001574 | 1/2012 |
| WO | 2012054456 | 4/2012 |
| WO | 2013085412 | 6/2013 |

OTHER PUBLICATIONS

Kirk-Othmer Enclyclopedia of Chemical Technology, vol. 7, pp. 297-299 (1965).

SPE 131783—Less Sand May Not be Enough, M. Curry, T. Maloney, R. Woodroff, and R. Leonard, Feb. 23-25, 2010, SPR Unconventional Gas Conference, Pittsburg, PA, USA.

ARMA/USRMS 05-780—Experiments and numerical simulation of hydraulic fracturing in naturally fractured rock, C.J. De Pater and L.J.L. Beugelsdijk, Jun. 25-29, 2010, The 40th U.S. Symposium of Rock Mechanics (USRMS), Anchorage, AK, USA.

Nolte, K.G.: "Application of Fracture Design Based on Pressure Analysis," SPE13393—SPE Production Engineering, vol. 3, No. 1, 31-42, Feb. 1988.

Nolte, K.G. and Smith, M.B.: "Interpretation of Fracturing Pressures,"—SPE8297—JPT, vol. 12, No. 8, pp. 1767-1775, Sep. 1981.

Smith, M.B., Miller II, W.K., and Haga, J.: "Tip Screenout Fracturing: A Technique for Soft, Unstable Formations," SPE13273—SPE Production Engineering, vol. 2, No. 2, 95-103, May 1987.

Asgian, M.I., Cundall, P.A., and Brady, B.H. (1995) "Mechanical Stability of Porpped Hydraulic Fractures: A Numerical Study",—SPE28510—JPT, 203-208, Mar. 1995.

Milton-Tayler, D., Stephenson, C., and Asgian, M. (1992) "Factors Affecting the Stability of Proppant in Propped Fractures: Results of a Laboratory Study," paper SPE 24821 presented at the SPE Annual Technical Conference and Exhibition, Washington, DC, Oct. 4-7.

Desroches, J., et al. (1993) On the Modeling of Near Tip Processes in Hydraulic Fractures. International journal of rock mechanics and mining sciences & geomechanics abstracts, 30(7): p. 1127-1134.

Desroches, J., et al. (1994) The Crack Tip Region in Hydraulic Fracturing. Proc. R. Soc. Lond. A, 447: p. 39-48.

Schlumberger CemCRETE Brochure (2003).

Schlumberger Cementing Services and Products—Materials, pp. 39-76 (2012).

SPE 119366—Fracture Design Considerations in Horizontal Wells Drilled in Unconventional Gas Reservoirs; Cipolla, C.L., Lolon, E.P., Mayerhofer, M.J., and Warpinski, N. R. (2009).

(56) References Cited

OTHER PUBLICATIONS

Economides M.J. and Nolte K.G., Reservoir Stimulation, John Wiley and Sons, Ltd, 3rd Edition New York, 2000—Chapter 10, "Fracture Treatment Design" by Jack Elbel and Larry Britt, (pp. 10-1 to 10-50).
Economides M.J. and Nolte K.G., Reservoir Stimulation, John Wiley and Sons, Ltd, 3rd Edition New York, 2000—Chapter 8, "Performance of Fracturing Materials" by V.G Constien et al., (pp. 8-1 to 8-26).
Economides M.J. and Nolte K.G., Reservoir Stimulation, John Wiley and Sons, Ltd, 3rd Edition New York, 2000—Chapter 5, "Basics of Hydraulic Fracturing " by M.B.Smith and J.W. Shlyapobersky, (pp. 5-1 to 5-28).
Economides M.J. and Nolte K.G., Reservoir Stimulation, John Wiley and Sons, Ltd, 3rd Edition New York, 2000—Chapter 7, "Fracturing Fluid Chemistry and Proppants" by Janet Gulbis and Richard M.Hogde, (pp. 7-1 to 7-23).
Aveyard et al; "Emulsions stabilised solely by colloidal particles"; Advances in Colloid and Interface Science 100-102 pp. 503-546 (2003).
Binks et al; "Pickering emulsions stabilized by monodisperse latex particles: Effects of particle size"; Langmuir vol. 17 iss:15 p. 4540-4547 (2001).
Montagne etal; "Highly magnetic latexes from submicrometer oil in water ferrofluid emulsions"; Journal of polymer science. Part A, Polymer chemistry vol. 44 iss:8 p. 2642-2656 (2006).
Park et al; "Rheological Properties and Stabilization of Magnetorheological Fluids in a Water-in-Oil Emulsion"; Journal of Colloid and Interface Science 240, 349-354 (2001).
Pickering, Su; "Emulsions" Journal of the Chemical Society vol. 91pp. 2001-2021 (1907).
Constien et al., Reservoir Stimulation, 3rd Edition, "Fluid loss under static conditions", John Wiley & Sons, Ltd. pp. 8-1 to 8-26, 2000.

* cited by examiner

DOWNHOLE TOOL POSITIONING SYSTEM AND METHOD

RELATED APPLICATION DATA

The current application claims the benefit of U.S. provisional application Ser. No. 61/726,340, filed on Nov. 14, 2012, titled "Downhole Tool Positioning System and Method", the entire content of which is incorporated herein by reference.

BACKGROUND

The statements in this section merely provide background information related to the present disclosure and may not constitute prior art.

With reference to FIG. 1, tools used in deviated and horizontal wellbore sections 10, 12 are difficult to move and position in the desired place in the wellbore for downhole operations. Unlike vertical and slightly deviated sections 14, 16, gravity and pipe or coiled tubing strings or wireline assemblies cannot always be used to translate the tool within the wellbore. For example, the string may drag against the walls of the wellbore at some point below where the deviation begins, and there may be a limit on the amount of downward thrust that can be applied to the string from the surface, particularly in the case of coiled tubing. Similarly, in retrieval of the tool, pipe, coiled tubing and wirelines may bind against the inner walls of the wellbore, and together with the weight of the pipe or tubing string or wireline assembly and the tool, the capacity of the string or wireline assembly, e.g., due to the tensile loading that can be withstood and/or the power limits of the retrieval machinery 18 at the surface 20, to pull the tool up may be exceeded.

Thus, crawler mechanisms known as tractors have been used to facilitate translation of downhole tools in deviated wellbores and laterals. Some of these tractors have shortcomings such as, for example, the requirement of an external electrical power supply, complex power and/or drive train arrangements, vulnerability to power and equipment failures, unidirectionality, i.e., the requirement of plural drive assemblies for bidirectional travel, slow insertion and retrieval speeds, abrupt and/or jerky movements of the tool downhole, and so on.

Improvements in downhole tool positioning systems and methods are desired.

SUMMARY

In some embodiments herein, downhole tool positioning systems and methods employing buoyancy-mediated tool displacement wherein the density of the tool and/or string, such as, for example, a coiled tubing or wireline assembly, and the treatment fluid are matched to facilitate translation of the tool in a deviated borehole or lateral borehole with or without a mechanical translation device. In further embodiments these systems and methods can also facilitate elevation and/or descent of the tool in vertical or slightly deviated boreholes.

In embodiments, a downhole tool positioning system, comprises a wellbore, a treatment fluid disposed within the wellbore, a tool disposed at least partially within the treatment fluid and substantially buoyant therein, and a treatment fluid control system to move the treatment fluid in the wellbore and control positioning of the tool in the wellbore.

In some embodiments herein, a method comprises providing a treatment fluid for use with a downhole tool and string in a wellbore comprising a vertical section in communication from the surface to at least one lateral, wherein the downhole tool is moveable in the lateral; providing the downhole tool and string with a weight and displacement that closely matches that of the treatment fluid, providing the treatment fluid with a density that closely matches the specific gravity of the downhole tool and string, or a combination thereof, such that the downhole tool and string are substantially buoyant in the treatment fluid; and flowing the treatment fluid in the wellbore to hydraulically translate the downhole tool in the wellbore.

BRIEF DESCRIPTION OF THE DRAWINGS

These and other features and advantages will be better understood by reference to the following detailed description when considered in conjunction with the accompanying drawings.

DETAILED DESCRIPTION OF SOME ILLUSTRATIVE EMBODIMENTS

Figure 1:
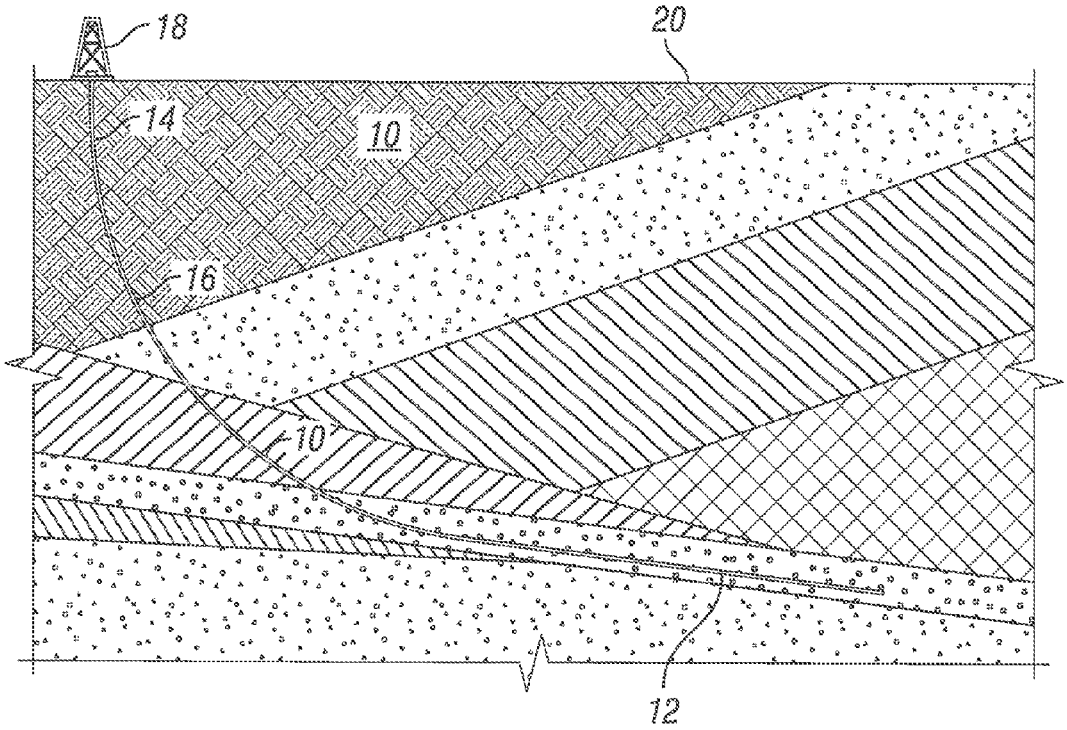
FIG. 1 is a schematic representation of a wellbore with deviated and horizontal sections.

For the purposes of promoting an understanding of the principles of the disclosure, reference will now be made to some illustrative embodiments of the current application.

Like reference numerals used herein refer to like parts in the various drawings. Reference numerals without suffixed letters refer to the part(s) in general; reference numerals with suffixed letters refer to a specific one of the parts.

As used herein, "embodiments" refers to non-limiting examples of the application disclosed herein, whether claimed or not, which may be employed or present alone or in any combination or permutation with one or more other embodiments. Each embodiment disclosed herein should be regarded both as an added feature to be used with one or more other embodiments, as well as an alternative to be used separately or in lieu of one or more other embodiments. It should be understood that no limitation of the scope of the claimed subject matter is thereby intended, any alterations and further modifications in the illustrated embodiments, and any further applications of the principles of the application as illustrated therein as would normally occur to one skilled in the art to which the disclosure relates are contemplated herein.

Moreover, the schematic illustrations and descriptions provided herein are understood to be examples only, and components and operations may be combined or divided, and added or removed, as well as re-ordered in whole or part, unless stated explicitly to the contrary herein. Certain operations illustrated may be implemented by a computer executing a computer program product on a computer readable medium, where the computer program product comprises instructions causing the computer to execute one or more of the operations, or to issue commands to other devices to execute one or more of the operations.

As used herein, the terms lateral and horizontal wellbore or wellbore section and similar terms interchangeably refer to a section of wellbore that has a slope within ±15 degrees of horizontal. In the specification and claims, a deviated wellbore section refers to a wellbore section having a slope greater than 20 degrees from vertical and greater than 15 degrees from horizontal; a slightly deviated wellbore section refers to a wellbore section having a slope between 5 and 20 degrees of vertical; a vertical wellbore section refers to a wellbore section that is vertical or has a slope less than or equal to 5 degrees from vertical. For example, a wellbore may comprise a plurality of laterals and/or deviated wellbore sections connected separately and/or serially to one or more vertical and/or slightly deviated sections.

As used herein, an inverted slope refers to a wellbore section sloped up from horizontal in a direction of travel through the wellbore away from the end of the wellbore at the surface and toward a "bottom end" of the wellbore section. In the specification and claims, the portion of the wellbore "above" a tool disposed therein refers to the section of the wellbore between a posterior end of the tool and the end of the wellbore at the surface, and "below" the tool to the section between an anterior end of the tool and the end of the wellbore or wellbore section in a subterranean formation, even though the sections may include one or more inverted-slope sections. Similarly, the bottom of the wellbore refers to the end of the wellbore or wellbore section at the respective end of the wellbore or section in the subterranean formation, regardless of the presence of inverted slope sections. A wellbore with a plurality of laterals or deviated sections may have a plurality of bottoms.

As used herein, substantially buoyant means the tool, string or other component is substantially floating in the local treatment fluid or tool, string or other component displaces at least half of its weight when submerged in the treatment fluid, i.e., the tool, string or other component have a weight and displacement (specific gravity) that closely matches the density (specific gravity) of the treatment fluid. In some embodiments, the tool and the string have a positive or negative buoyancy that is fixed or adjustable to less than 50% of the weight of the local treatment fluid that is displaced. In some embodiments, the tool and the string have a positive or negative buoyancy that is fixed or adjustable to less than 35% of the weight of the local treatment fluid that is displaced. In some embodiments, the tool and the string have a positive or negative buoyancy that is fixed or adjustable to less than 15% of the weight of the local treatment fluid that is displaced. In some embodiments, the tool and the string have a positive or negative buoyancy that is fixed or adjustable to less than 10% of the weight of the local treatment fluid that is displaced. In some embodiments, the tool and the string have a positive or negative buoyancy that is fixed or adjustable to less than 5% of the weight of the local treatment fluid that is displaced. In some embodiments, the tool and the string have a weight that is substantially equal to the weight of the local treatment fluid that is displaced.

In some embodiments, the treatment fluid has a specific gravity that is within +/−50% of that of the tool. In some embodiments, the treatment fluid has a specific gravity that is within +/−35% of a specific gravity of the tool. In some embodiments, the treatment fluid has a specific gravity that is within +/−15% of a specific gravity of the tool. In some embodiments, the treatment fluid has a specific gravity that is within +/−10% of a specific gravity of the tool. In some embodiments, the treatment fluid has a specific gravity that is within +/−5% of a specific gravity of the tool. In some embodiments, the treatment fluid has a specific gravity that is substantially the same as a specific gravity of the tool.

It should be understood that, although a substantial portion of the following detailed description is provided in the context of deploying a tool for oilfield hydraulic fracturing operations, other oilfield operations such as cementing, gravel packing, etc., or even non-oilfield well treatment operations, can utilize and benefit from the tool deployment and positioning system of the disclosure of the current application as well. Similarly, it should be understood that, although a substantial portion of the following detailed description is provided in the context of a horizontal wellbore cased and cemented in the subterranean formation, the methods, and/or systems described herein are not necessarily limited to such application. Vertical or deviated wells, non-cased wells, non-completed wells, partially completed wells, open-hole wells, non-perforated completions, etc. can also utilize and benefit from the disclosure of the current application. All variations that can be readily perceived by people skilled in the art having the benefit of the current application should be considered as within the scope of the current application.

In some embodiments, a downhole tool positioning system comprises a wellbore; a treatment fluid disposed within the wellbore; a substantially buoyant tool optionally connected to a string in the wellbore disposed at least partially within the treatment fluid; a specific gravity balance between the treatment fluid and the tool, any string or a combination thereof wherein the tool and the string are substantially buoyant within the treatment fluid; and a treatment fluid control system to move the treatment fluid in the wellbore to control positioning of the tool in the wellbore.

In embodiments, the treatment fluid comprises a slurry having a specific gravity of at least 1.5, 2.0, 2.5, 3.0, 3.5, 4.0, 4.5, 5.0, 5.5, 6.0, 6.5, 7.0, 7.5, 8.0, 8.5, 9.0, 9.5, 10.0, 10.5, 11.0, 11.5, 12.0, 12.5, 13.0, 13.5, 14.0, 14.5, 15.0, 15.5, 16.0, 16.5, 17.0, 17.5 or 18.0. In some embodiments, the treatment fluid comprises a slurry having a specific gravity of at least 4.0. In some embodiments, the treatment fluid comprises a slurry having a specific gravity of at least 6.0. In some embodiments, the treatment fluid comprises a slurry having a specific gravity of at least 7.0. In some embodiments, the treatment fluid comprises a slurry having a specific gravity of at least 7.8. The density of the treatment fluid is a function of the density of the carrier fluid and the density of the solids phase and solids loading in the carrier fluid, also sometimes referred to herein as the slurry solids volume fraction (SVF). The carrier fluid density can be lower than water (1.0 g/mL), e.g., gas (as in a foam or energized fluid), alcohol, ethylene glycol, hydrocarbon, etc., or greater than water, e.g., brine (up to about 25 g/mL), glycerol (1.261 g/mL), tetrachloroethylene (1.622 g/mL), diiodomethane (3.3 g/mL), mercury (13.5 g/mL), etc. The density of the solids phase can be selected from a range of materials, e.g., as in the following table:

| Material | Approximate Density (g/mL) |
|---|---|
| Expanded polystyrene | 0.075 |
| Cork | 0.240 |
| Lithium | 0.535 |
| Potassium | 0.86 |
| Ice | 0.917 |
| Sodium | 0.97 |
| Magnesium | 1.74 |
| Beryllium | 1.85 |
| Silicon | 2.33 |
| Silica sand | 2.65 |
| Aluminum | 2.7 |
| Diamond | 3.5 |
| Titanium | 4.54 |
| Selenium | 4.8 |
| Vanadium | 6.1 |
| Antimony | 6.69 |
| Zinc | 7.0 |
| Chromium | 7.2 |
| Tin | 7.31 |
| Manganese | 7.32 |
| Iron | 7.87 |
| Niobium | 8.57 |
| Cadmium | 8.65 |
| Nickel | 8.9 |
| Cobalt | 8.9 |
| Copper | 8.94 |
| Bismuth | 9.75 |
| Molybdenum | 10.2 |
| Silver | 10.5 |
| Lead | 11.3 |
| Thorium | 11.7 |
| Rhodium | 12.4 |
| Tantalum | 16.6 |
| Uranium | 18.8 |
| Tungsten | 19.3 |
| Gold | 19.3 |
| Plutonium | 19.8 |
| Platinum | 21.45 |
| Iridium | 22.4 |
| Osmium | 22.6 |

In some embodiments, the density of the solids can be adjusted by using gas-filled solids, e.g., hollow spheres, expandable materials, etc., or by encapsulating a lower or higher density material within a respectively higher or lower density encapsulating material. The density of the treatment fluid may also be adjusted in situ by using degradable solids that dissolve or degrade into liquid or soluble products, expandable solids, e.g., solids swellable in the fluid phase, solutes that precipitate from the carrier fluid at downhole conditions, and so on. In situ adjustment of the density of the treatment fluid may in some embodiments facilitate adjustment of the buoyancy of the tool and/or any string in different locations in the wellbore, e.g., a first density of the treatment fluid in the wellbore in a first location or time, and a second density in a second location or time, such as, for example, a lighter treatment fluid in a vertical wellbore section for negative buoyancy of the tool/string during the descent of the tool, matching densities for neutral buoyancy for horizontal translation of the tool/string in a lateral, a heavier treatment fluid in a vertical wellbore section for positive buoyancy of the tool/string during ascent, and so on.

In some embodiments, the particle size distribution of the solids phase can be adjusted to allow a higher solids volume fraction (SVF), e.g., using a graded or multimodal particle size distribution so that the particles may pack more closely together by randomly locating smaller particles that can fit in the interstices between larger particles, while still maintaining flowability of the slurry.

In some embodiments, the treatment fluid is stabilized to meet at least one of the following conditions: (1) the slurry has a low-shear viscosity equal to or greater than 1 Pa-s (5.11 s−1, 25° C.); (2) the slurry has a Herschel-Buckley (including Bingham plastic) yield stress (as determined in the manner described herein) equal to or greater than 1 Pa; (3) the largest particle mode in the slurry has a static settling rate less than 0.01 mm/hr; (4) the depth of any free fluid at the end of a 72-hour static settling test condition or an 8 h@15 Hz/10 d-static dynamic settling test condition (4 hours vibration followed by 20 hours static followed by 4 hours vibration followed finally by 10 days of static conditions) is no more than 2% of total depth; (5) the apparent dynamic viscosity (25° C., 170 s−1) across column strata after the 72-hour static settling test condition or the 8 h@15 Hz/10 d-static dynamic settling test condition is no more than +/−20% of the initial dynamic viscosity; (6) the slurry solids volume fraction (SVF) across the column strata below any free water layer after the 72-hour static settling test condition or the 8 h@15 Hz/10 d-static dynamic settling test condition is no more than 5% greater than the initial SVF; (7) the density across the column strata below any free water layer after the 72-hour static settling test condition or the 8 h@15 Hz/10 d-static dynamic settling test condition is no more than 1% of the initial density.

In some embodiments, the treatment fluid comprises a slurry having a viscosity less than 500 mPa-s (170 $s^{-1}$, 25° C.) and a yield stress between 1 and 20 Pa (2.1-42 $lb_f/ft^2$); or a viscosity less than 300 mPa-s (170 $s^{-1}$, 25° C.), a solids phase having a packed volume fraction (PVF) greater than 0.72, a slurry solids volume fraction (SVF) less than the PVF and a ratio of SVF/PVF greater than about 1−2.1*(PVF−0.72).

In some embodiments, the treatment fluid comprises a slurry comprising a fluid loss control agent.

In some embodiments, the wellbore comprises a vertical section in communication from the surface to at least one lateral, wherein the substantially buoyant tool is moveable in the lateral via the slurry circulation control system.

As used herein, a "string" refers to any tether by which the tool is connected to the surface. In some embodiments, the tool is not connected to a string. In some embodiments, a string is connected to the tool. In some embodiments, the string is a wireline, a slickline, a pipe, or tubing, e.g., coiled tubing. In some embodiments, the string has neutral buoyancy adjacent the tool. In some embodiments, a wireline assembly is connected to the tool. In some embodiments, the wireline assembly is substantially buoyant at least adjacent the tool, e.g., in the lateral.

In some embodiments, the tool and/or the string (where present and connected to the tool) have a positive or negative buoyancy less than 15%, or less than 10%, or less than 5%, or less than 2%, or less than 1%, or less than 0.5%, or less than 0.1%, of the weight of the treatment fluid displaced by the tool and/or string.

In some embodiments, the tool and/or any string connected to the tool comprise a buoyancy adjustment system to increase or decrease displacement of the tool and/or string. In representative examples of these embodiments, the treatment fluid(s) may be selected, e.g., depending on the application constraints required for the treatment fluid(s), the density of the treatment fluid determined, and then the downhole tool and/or string provided with the specific gravity that closely matches the treatment fluid(s), e.g., by provisioning the tool and/or string with buoyancy devices and/or ballast as required.

In some embodiments, the system further comprises a slurry mixer to adjust the density of the treatment fluid(s). In representative examples of these embodiments, the tool and/or string may be selected, e.g., depending on the application constraints required for the tool and/or string, the weight and displacement of the downhole tool and any string determined, and the density of the treatment fluid(s) adjusted to closely match the specific gravity of the downhole tool and/or string. In some embodiments, specific gravity of the tool/string and/or of the treatment fluid, may both be adjusted, e.g., by (1) increasing or decreasing the density of the treatment fluid by controlling the amount (SVF) and specific gravity of the solids phase and/or by controlling the specific gravity of the fluid phase, and (2) adding, removing and/or adjusting buoyancy and/or ballast devices in or on the tool and/or string. The specific gravity adjustment of the treatment fluid and/or the tool/string in these embodiments may be effected at the surface, downhole or a combination thereof.

In some embodiments, a fluid control system is provided to supply to or remove one or more fluids from the wellbore, or a combination thereof, wherein the one or more fluids comprise at least the slurry. In some embodiments, the fluid control system comprises a first fluid flow path into a first cylinder adjacent a posterior end of the tool, a second fluid flow path into a second cylinder adjacent an anterior end of the tool, and a fluid controller to match a fluid volume increase in one of the first or second cylinders with a corresponding fluid volume decrease in the other one of the first or second cylinders. In some embodiments, the first cylinder comprises an annulus between an inner surface of the wellbore and a pipe or coiled tubing string, the second cylinder comprises a portion of the wellbore between the anterior end of the tool and a well closure below the tool, and the second flow path comprises a central passage through the pipe or coiled tubing string.

In some embodiments, the tool comprises a transverse fin. In some embodiments the tool may comprise a wiper to optionally form a fluid seal with a surface of the wellbore. In some embodiments, the tool comprises a tractor.

In some embodiments, the wellbore comprises a vertical section in communication from the surface to at least one lateral, wherein the substantially buoyant tool is moveable in the lateral via the fluid circulation control system, wherein the wellbore comprises first and second liquid columns in the wellbore, wherein the first liquid column comprises a slurry and the second liquid column comprises a relatively lighter fluid having a lower specific gravity than the slurry, and wherein the liquid columns are hydraulically connected at a managed interface to inhibit mixing between the slurry and the lighter fluid. In some embodiments, the tool has a specific gravity less than the slurry and greater than the lighter fluid to maintain neutral buoyancy of the tool across the managed interface in the vertical section. In some embodiments, the first liquid column is disposed in an annulus between a wall of the wellbore and an outer surface of a string connected to the tool. In some embodiments, the first liquid column is disposed in an annulus between a wall of the wellbore, wherein the slurry circulation control system comprises: a slurry reservoir connection for supplying slurry from the slurry reservoir to the annulus or returning slurry from the annulus to the slurry reservoir, a lighter fluid reservoir connection for supplying the lighter fluid from the lighter fluid reservoir to the string or returning lighter fluid from the string to the lighter fluid reservoir, or a combination thereof.

In some embodiments, a method comprises: determining weight and displacement volume of a downhole tool for use in a wellbore comprising a vertical section in communication between the surface and at least one lateral, wherein the downhole tool is moveable in the lateral; introducing a treatment fluid into the lateral wherein the treatment fluid has a density to match that of the downhole tool to provide the downhole tool with substantial buoyancy in the treatment fluid in the lateral; flowing the treatment fluid within the lateral with respect to a surface of the lateral, the downhole tool or a combination thereof, to hydraulically translate the downhole tool within the lateral.

In some embodiments, the method further comprises stabilizing the slurry to inhibit solids settling by at least one of: (1) introducing sufficient particles into the slurry or treatment fluid to increase the SVF of the treatment fluid to at least 0.4; (2) increasing a low-shear viscosity of the slurry or treatment fluid to at least 1 Pa-s (5.11 s−1, 25° C.); (3) increasing a yield stress of the slurry or treatment fluid to at least 1 Pa; (4) increasing apparent viscosity of the slurry or treatment fluid to at least 50 mPa-s (170 s−1, 25° C.); (5) introducing a multimodal solids phase into the slurry or treatment fluid; (6) introducing a solids phase having a PVF greater than 0.7 into the slurry or treatment fluid; (7) introducing into the slurry or treatment fluid a viscosifier selected from viscoelastic surfactants, e.g., in an amount ranging from 0.01 up to 7.2 g/L (60 ppt), and hydratable gelling agents, e.g., in an amount ranging from 0.01 up to 4.8 g/L (40 ppt) based on the volume of fluid phase; (8) introducing colloidal particles into the slurry or treatment fluid; (9) reducing a particle-fluid density delta to less than 1.6 g/mL (e.g., introducing particles having a specific gravity less than 2.65 g/mL, carrier fluid having a density greater than 1.05 g/mL or a combination thereof); (10) introducing particles into the slurry or treatment fluid having an aspect ratio of at least 6; (11) introducing ciliated or coated proppant into slurry or treatment fluid; and (12) combinations thereof. The slurry stabilization operations may be separate or concurrent, e.g., introducing a single viscosifier may also increase low-shear viscosity, yield stress, apparent viscosity, etc., or alternatively or additionally with respect to a viscosifier, separate agents may be added to increase low-shear viscosity, yield stress and/or apparent viscosity.

In some embodiments, the method further comprises operating the downhole tool to perforate the surface of the lateral into an adjacent subterranean formation.

In some embodiments, the method further comprises mechanically assisting the translation. In some embodiments, the method further comprises operating a propeller or pump on the tool to induce fluid flow with respect to the tool. In some embodiments, the method further comprises deploying a wiper to form a fluid seal between the tool and a surface of the lateral. In some embodiments, the method further comprises anchoring the tool in the lateral.

In some embodiments, the method further comprises supplying to or removing one or more fluids from the wellbore, or a combination thereof to induce movement of the tool in the lateral. In some embodiments, the method further comprises changing a first fluid volume in a first cylinder adjacent a posterior end of the tool, a second fluid volume in a second cylinder adjacent an anterior end of the tool, match a fluid volume increase in one of the first or second cylinders with a corresponding fluid volume decrease in the other one of the first or second cylinders. In some embodiments, the first cylinder comprises an annulus between an inner surface of the wellbore and a pipe or coiled tubing string, the second cylinder comprises a portion of the wellbore between the anterior end of the tool and a well closure below the tool, and changing the second fluid volume via a flow path comprising a central passage through a pipe or coiled tubing string connected to the tool.

Figure 2:
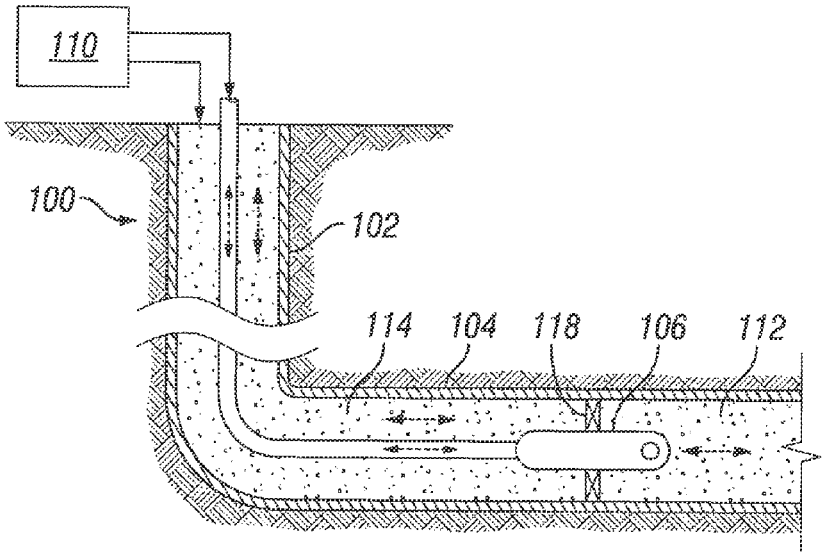
FIG. 2 is a schematic configuration of a downhole tool positioning system according to embodiments of the invention.

With reference to the embodiments shown in FIG. 2, a wellbore 100 may comprise a vertical section 102 and a deviated section or lateral 104. A tool 106 is deployed in the wellbore 100 and may be connected to the surface via a riser 108 which may be a cable or wireline assembly or a string such as a pipe string or coiled tubing string. The tool 106 may be any appropriate downhole tool, such as, for example, a logging tool, perforating gun, etc. A treatment fluid circulation control system 110, hereafter referred to as a slurry circulation system for purposes of exemplification and not limitation, is provided to circulate the treatment fluid at least into and optionally from the wellbore. Because the tool 106 may be substantially buoyant in the treatment fluid present in the wellbore according to some embodiments herein, the flow of the treatment fluid within the wellbore may convey the tool 106 within the wellbore, forward fluid flow moving the tool forward (toward the end or bottom terminus of the wellbore) and reverse flow moving the tool back (toward the surface connection). In the lateral section 104, the neutral buoyancy of the tool may minimize drag between the tool and the wellbore surface. The riser 108 in some embodiments may also be substantially buoyant, further facilitating the minimization of drag.

In some embodiments the tool and/or the riser or other device has a positive or negative buoyancy less than 15%, or less than 10%, or less than 5%, or less than 2%, or less than 1%, or less than 0.5%, or less than 0.1%, of the displacement of the tool and/or the riser or other device. The buoyancy of the tool and/or the riser may be adjusted by employing buoyancy trim devices such as ballast and/or flotation devices such as buoyant sheathing or chambers on or within the device, or integral or attached to the device. The buoyancy trim devices may be fixed or detachable, or in some embodiments adjustable. For example, the buoyancy trim devices may be used to obtain negative buoyancy to facilitate deployment of the tool in the wellbore in the vertical (or slightly deviated) section, which may thereafter be or be used with additional buoyancy trim devices that are jettisoned, dissolved, expanded and/or inflated to facilitate neutral buoyancy for translation within the lateral and/or positive buoyancy for retrieval of the tool from the vertical wellbore section. Additional examples of adjustable buoyancy tools are disclosed in U.S. Pat. No. 7,195,066; U.S. Pat. No. 6,443,228; U.S. Pat. No. 6,273,189; US 2005/0241835 A1; and US 2002/0096322, each of which is incorporated herein by reference.

Figure 3:
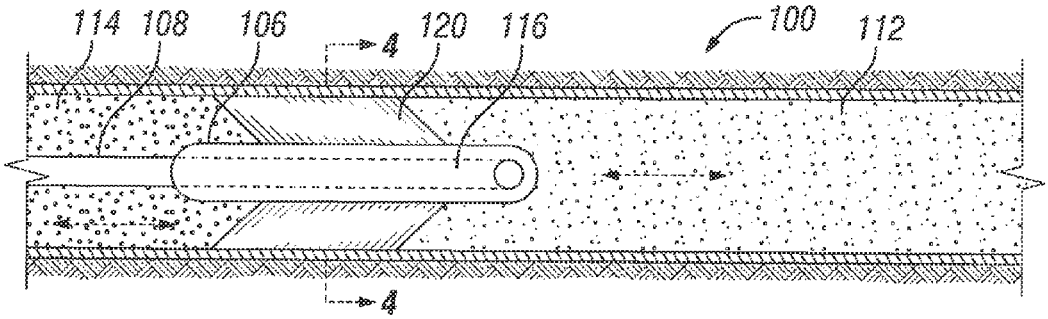
FIG. 3 shows a schematic representation of another downhole tool positioning system in a lateral according to embodiments.
Figure 4:
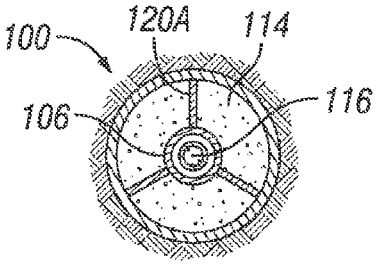
FIG. 4 shows a cross section of the tool of FIG. 3 as seen along the lines 4-4.
Figure 5:
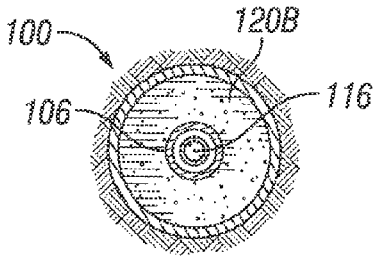
FIG. 5 shows another cross section of a further version of the tool of FIG. 3 as seen along the lines 4-4.

With reference to FIG. 3, in some embodiments the tool 106 and/or riser 108 are filled with or may contain a fluid, which may optionally comprise a slurry treatment fluid or a clear treatment fluid, that is relatively lighter than the motive treatment fluid in which the tool and/or riser are deployed, e.g., in the example where a lighter fluid is removed from or supplied to the wellbore below the tool in the wellbore section 112, and/or wherein the relatively denser slurry may be respectively supplied to or removed from the annulus 114 above the tool by an equivalent volume to maintain the wellbore in a fluid-filled condition. The riser 108 and/or the tool 106 may comprise a central flow passage 116 therethrough to receive the treatment fluid as best seen in FIGS. 3-5. The presence of a lighter treatment fluid in the central passage 116 relative to the denser fluid in the annulus 114 provides positive buoyancy equal to the product of the density difference between the two fluids times the volume of the fluid in the central passage.

In some embodiment, a managed interface 118 (see FIG. 2) is utilized to facilitate the movement of the tool 106 and/or any connected tubing or wireline. The managed interface 118 can be a mechanical device such as a wiper or bladder, or a fluid device such as a plug of viscous and/or immiscible liquid, or a combination of one or a plurality of mechanical devices and/or one or a plurality of fluid devices. In some embodiment, a managed interface 118 is not employed.

Where the treatment fluid comprises different fluids in the annulus 114 and the central passage 116, the intermixing between the different fluids may be inhibited by means of a managed interface 118 (see FIG. 2), which may be a mechanical device such as a wiper or bladder, or a fluid device such as a plug of viscous and/or immiscible liquid, or a combination of one or a plurality of mechanical devices and/or one or a plurality of fluid devices. Whether the treatment fluid is the same throughout the wellbore or comprises two or more different treatment fluids, the circulation of the fluid in the wellbore 100 may simultaneously push on the tool 106 by introducing fluid into the annulus 114 behind or above the tool and pull on the tool by removing fluid via the central flow passage 116 from the wellbore ahead of or below the tool, to move the tool in the direction of insertion toward the bottom of the wellbore. Conversely, to move the tool 106 in the direction of retrieval toward the surface, the circulation of the fluid may simultaneously push on the tool 106 by introducing fluid via the central flow passage 116 into the wellbore 100 below the tool, and pull on the tool by removing fluid from the annulus 114 above the tool.

It shown be noted that although in FIG. 2, the managed interface 118 is depicted as a device disposed around the middle point of the long axis of the tool 106, the actual positioning of the managed interface can be varied subject to the specific design of the tool or the job. In some embodiment, the managed interface 118 is positioned around the upper or proximal end of the tool 106. In some embodiment, the managed interface 118 is positioned around the lower or distal end of the tool 106. In some embodiment, the managed interface 118 is positioned around the string, tubing, riser, or wireline that connects the tool 106 to the surface 20.

In embodiments, the tool 106 may be provided with one or more radially outwardly extending projections 120 to facilitate centering, conveyance or the like. See FIG. 3. As seen in FIG. 4, the projections 120A comprise a set of centering devices such as calipers or outwardly biased wheel assemblies, which may be rectractable, e.g., during translation of the tool. As seen in FIG. 5, the projection 120B is in the form of a radial fin, which may be a wiper to form a fluid seal against the inner surface of the wellbore 100. The fin 120B extends radially into the annulus 114 to inhibit slip and/or promote drag between the treatment fluid in the annulus and the outer surface of the tool and thereby facilitate conveyance of the tool 106 according to movement of the fluid surrounding the tool.

Figure 6:
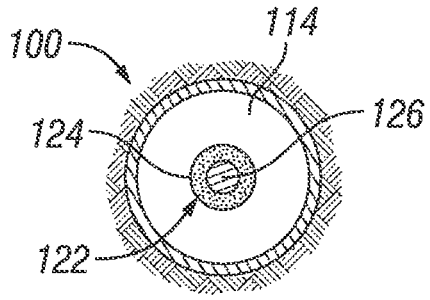
FIG. 6 shows a cross section of a riser with a buoyant sheathing.

FIG. 6 shows a cross section according to embodiments wherein the riser 108 comprises a wireline assembly 122 attached to the tool 106 (FIG. 3), provided with a low density flotation jacket 124, which may be expanded polystyrene, expanded polypropylene or the like that can be formed integral with the cable(s) 126 or removeably secured thereto.

Figure 7:
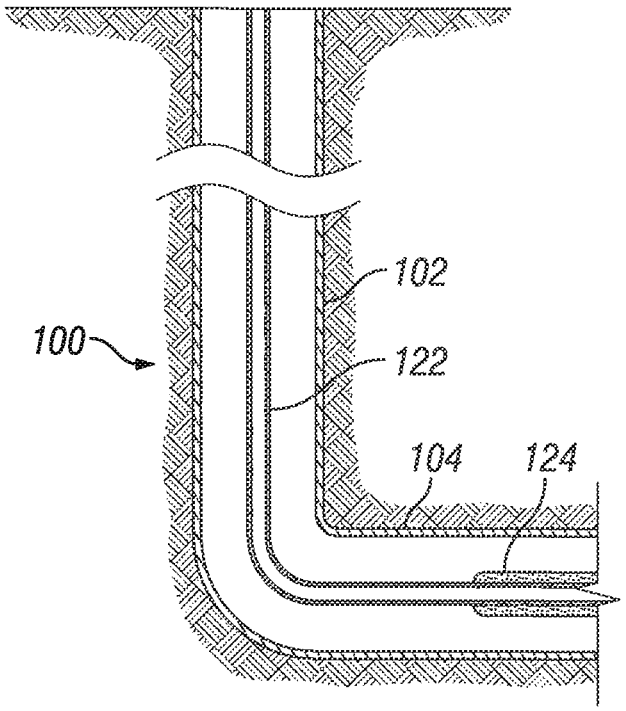
FIG. 7 shows a schematic view of a riser with a partial buoyant sheathing.

In some embodiments, as shown in FIG. 7, at least a first portion of the wireline assembly 122, e.g., adjacent to the tool 106 and/or disposed in the lateral 104, is provided for substantial buoyancy of the wireline assembly in those regions; while a second portion of the wireline assembly may optionally be free of added or deployed buoyancy devices to facilitate negative buoyancy in the vertical section 102. In some embodiments the buoyancy device(s) 124 are provided which may be selectively deployable or activatable, for example they may remain undeployed during insertion of the tool 106 in the vertical section and deployed before, during or after entry into the lateral 104 for neutral or positive buoyancy during positioning and/or use of the tool 106. Similarly, they may be deployed in the vertical section of the wellbore to facilitate retrieval.

Figure 8:
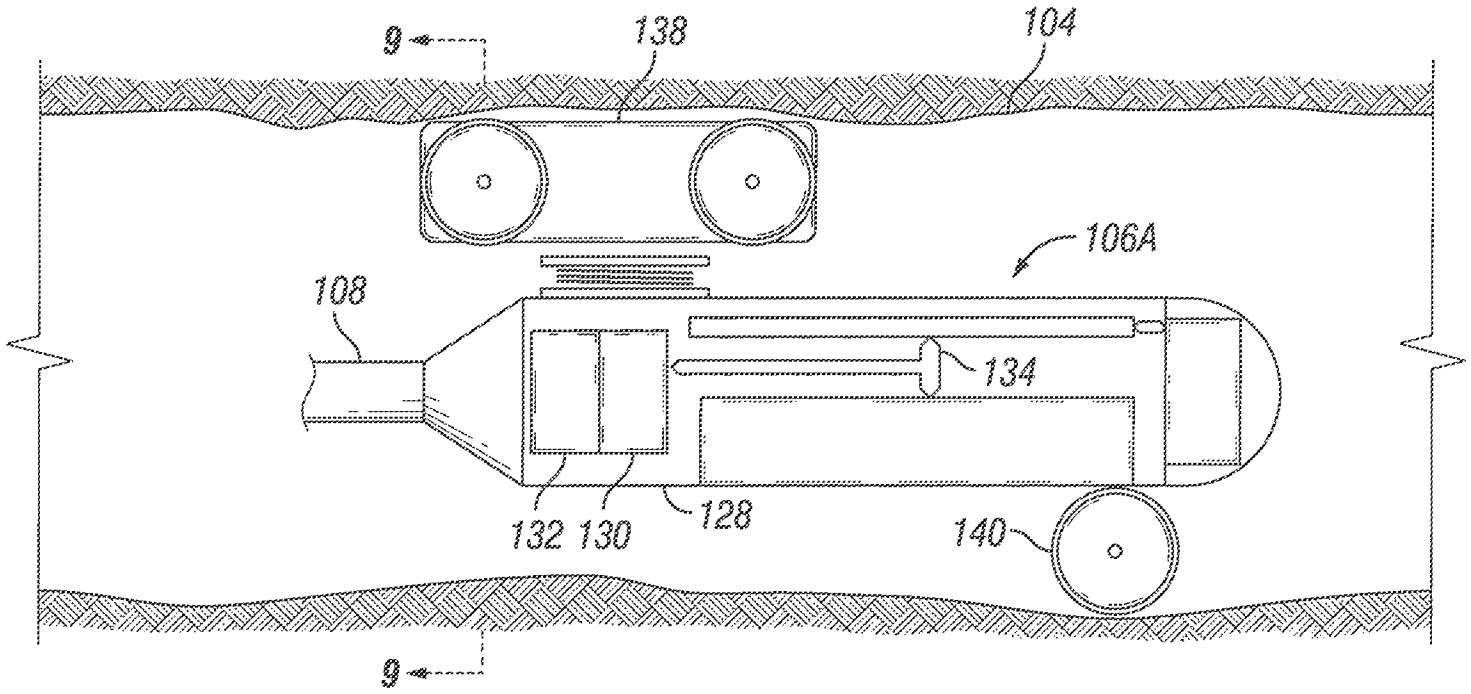
FIG. 8 shows a schematic cross-section of a down hole tool with a supplemental tractor drive in accordance with embodiments.

Referring to FIG. 8, a downhole tool 106A of a representative type which may be employed herein in accordance with embodiments, has a main body 128 which includes an electric motor unit 130, an optional battery unit 132, and an on-board processing system 134. In some cases, it may suffice to provide an "umbilical cord" between a wireline unit to provide electrical power and/or to supplement the battery, or the battery may be provided as a backup in the event of a power supply failure. The on-board processing system or logic unit may include a multiprocessor (e.g. a Motorola 680X0 processor) that controls via a bus system with I/O control circuits and a high-current driver for the locomotion unit and other servo processes, actuators, and sensors. Also part of the on-board processing may be a flash memory type data storage to store acquired data. A locomotion unit or tractor may be provided to supplement or assist the fluid conveyance drive to translate the tool 106A within the wellbore. The locomotion unit may include a caterpillar rear section 138 and a wheel front section 140.

Figure 9:
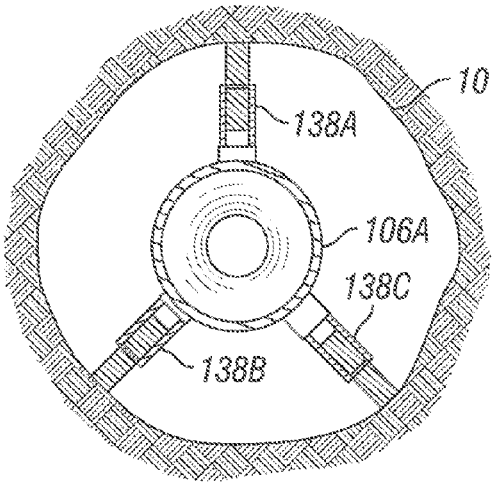
FIG. 9 is a cross section of the tool of FIG. 8 as seen along the lines 9-9.

As shown in FIG. 9, the three caterpillar tracks 138A, 138B, 138C are arranged along the outer circumference of the main body at 120 degree spacing. The arrangement of the three wheels of the front section 140 may be phase-shifted by 60 degrees with respect to the caterpillar tracks. The direction of the motion is reversed by reversing the rotation of the caterpillar tracks. Steering and motion control are largely simplified by the essentially one-dimensional nature of the path. To accommodate for the unevenness of the bore hole, the caterpillar tracks and the wheels may be biased outwardly, e.g., by springs. The locomotion unit can be replaced by a fully wheeled variant or a full caterpillar traction. Other possibilities include legged locomotion units as known in the art. The caterpillar tracks or the other locomotion means contemplated herein are characterized by having a confined area of contact with wall of the wellbore. Hence, during the motion phase an essentially annular region is left between the outer hull of the unit and the wall of the wellbore for the passage of well fluids.

Figure 10:
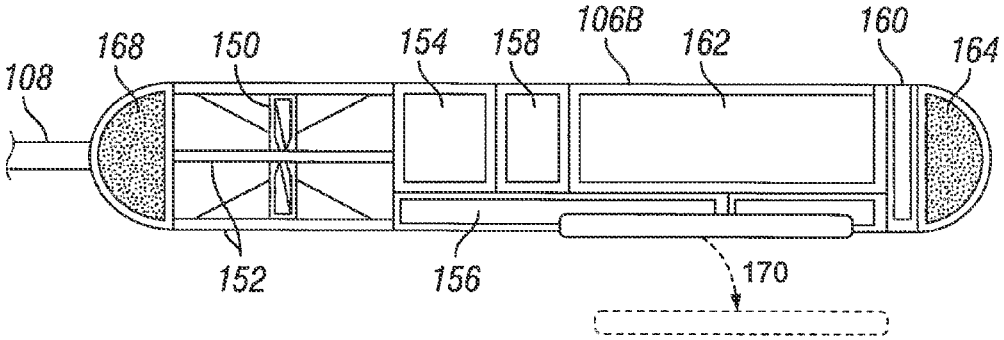
FIG. 10 shows a schematic cross-section of a downhole tool with a supplemental propeller drive, releasable ballast and buoyancy trim, in accordance with embodiments.

Referring now to FIG. 10, the supplemental locomotion unit comprises a propeller unit 150, surrounded and protected by four support rods 152. The propeller unit may be used to supplement the motive treatment fluid to position the tool 106B in the lateral. The unit moves in a "U-Boat" style, with neutral buoyancy to minimize drag from sliding in contact with the bottom or other surface(s) of the horizontal wellbore section. The tool 106B may comprise a motor and gear box 154, a battery unit 156, a central processing unit 158, and sensor assembly 160, optionally including a temperature sensor, a pressure sensor, an inclinometer and a video camera unit 162. The main body of the tool 106B has a neutral buoyancy in the environment of the treatment fluid. The buoyancy is achieved by encapsulating the major components in a pressure-tight cell filled with gas, e.g., air or nitrogen, and selecting a treatment fluid with a matching specific gravity. In addition, the buoyancy can be tuned using two chambers 164, 168, located at the front and rear end of the tool by ejecting the liquid using compressed gas or venting the gas from the chambers 164, 168 which will then fill with the surrounding treatment fluid.

During the descent through the vertical section of the borehole, negative buoyancy may be further provided by dense fluid such as a liquid or slurry which may be the treatment fluid, and/or by providing a ballast section 170. The ballast section 170 is designed to give the unit a negative buoyancy. The ballast section 170 may be released in the well, for example, by selecting a ballast material which dissolves under down hole conditions, e.g., rock salt or fine grain metal shot glued together with a dissolvable glue.

Figure 11:
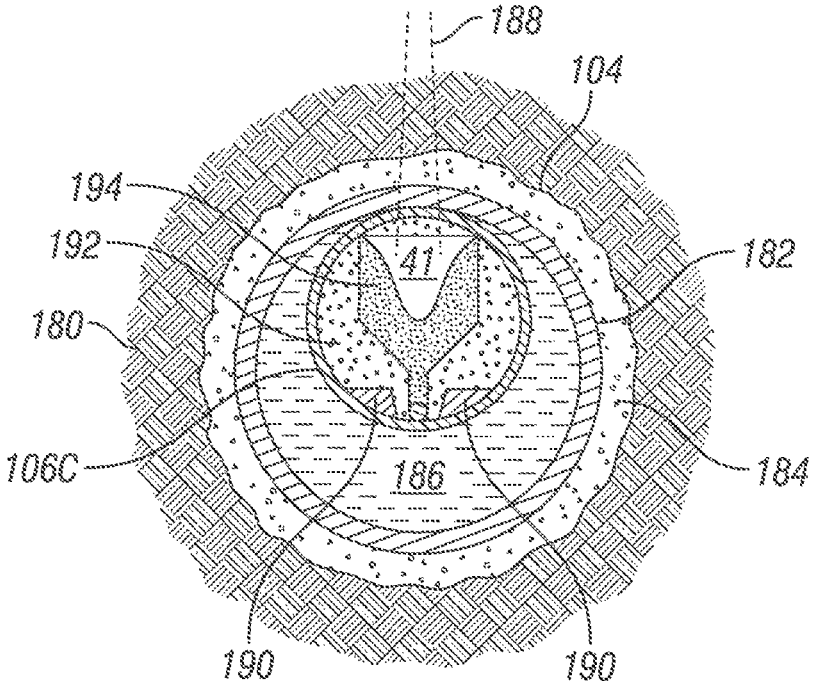
FIG. 11 shows a schematic cross-section of a down hole perforating gun tool in accordance with embodiments.

Referring to FIG. 11, a subterranean formation 180 is penetrated by the lateral 104, and is lined by casing 182 set in cement 184. The casing 182 is filled with treatment fluid 186. After the wellbore is cased, the casing 182 and cement sheath 184 must be perforated to allow reservoir fluid production into the casing interior and ultimately, into a production tube not shown. Typically, the casing, cement sheath and formation are perforated by the shaped charge jet as represented by the converging dashed lines 188 of FIG. 11. The mechanism of such perforations may be a perforation gun tool 106C. Typically, the perforating gun is an assembly of several charge carriers. Two or more charge carrier units may be linked by swivel joints for relative rotation about a longitudinal tube axis to facilitate gravity orientation. For orienting a horizontally positioned downhole tool 106C with respect to a vertical plane, as a non-limiting example, the outer perimeter of a charge carrier wall may be fabricated eccentrically of the inner bore perimeter thereby creating a weighted moment of wall mass concentration eccentrically concentrated about the charge carrier axis. If allowed to rotate about the charge carrier axis, the line of eccentrically concentrated wall mass will seek a bottom-most position. As shown in FIG. 11, the orientation technique comprises a pair of ballast rails 190 that may be secured to the inner wall surface of the tool 106C. The ballast rails 190 may be separated by a V-channel. A loading tube 192 is formed with a ridge that rotatively confines alignment of the loading tube between the ballast rails 190. The loading tube 192 may be a light weight element such as foamed polystyrene or polypropylene or similar large cell, expanded plastic material. At appropriately spaced locations along the loading tube 192 sockets may receive preformed units of shaped charge 194.

The tool 106C may be deployed with a negative and/or neutral buoyancy into the lateral 104, and when translated into position the buoyancy may be adjusted to elevate the tool 106C to the upper portion of the lateral for proper ignition of the shaped charges to perforate the casing 182.

In certain embodiments herein, the treatment fluid may contain proppant, e.g., when the tool is used in conjunction with gravel packing, hydraulic fracturing, or a combination frac-and-pack operation. In embodiments, the proppant-containing treatment fluid comprises a viscosity less than 300 mPa-s (170 $s^{-1}$, 25° C.) and a yield stress between 1 and 20 Pa (2.1-42 $lb/ft^2$). In embodiments, the proppant-containing treatment fluid comprises 0.36 L or more of proppant volume per liter of proppant-containing treatment fluid (equivalent to 8 ppa proppant where the proppant has a specific gravity of 2.6), a viscosity less than 300 mPa-s (170 $s^{-1}$, 25° C.), a solids phase having a packed volume fraction (PVF) greater than 0.72, a slurry solids volume fraction (SVF) less than the PVF and a ratio of SVF/PVF greater than about 1−2.1*(PVF−0.72). In embodiments, the proppant-containing treatment fluid comprises 0.4 L or more of proppant volume per liter of proppant-containing treatment fluid (9 ppa where the proppant has a specific gravity of 2.6), or 0.45 L or more of proppant volume per liter of proppant-containing treatment fluid (10 ppa where the proppant has a specific gravity of 2.6). In embodiments, the method further comprises preparing the proppant-containing treatment fluid by combining at least 0.36, at least 0.4 or at least 0.45 L of proppant per liter of whole fluid and stabilizing the proppant-containing treatment fluid.

As used herein, the terms "treatment fluid" or "wellbore treatment fluid" are inclusive of "fracturing fluid" or "treatment slurry" and should be understood broadly. These may be or include a liquid, a solid, a gas, and combinations thereof, as will be appreciated by those skilled in the art. A treatment fluid may take the form of a solution, an emulsion, slurry, or any other form as will be appreciated by those skilled in the art.

As used herein, "slurry" refers to an optionally flowable mixture of particles dispersed in a fluid carrier. The terms "flowable" or "pumpable" or "mixable" are used interchangeably herein and refer to a fluid or slurry that has either a yield stress or low-shear (5.11 $s^{-1}$) viscosity less than 1000 Pa and a dynamic apparent viscosity of less than 10 Pa-s (10,000 cP) at a shear rate 170 $s^{-1}$, where yield stress, low-shear viscosity and dynamic apparent viscosity are measured at a temperature of 25° C. unless another temperature is specified explicitly or in context of use.

"Viscosity" as used herein unless otherwise indicated refers to the apparent dynamic viscosity of a fluid at a temperature of 25° C. and shear rate of 170 $s^{-1}$. "Low-shear viscosity" as used herein unless otherwise indicated refers to the apparent dynamic viscosity of a fluid at a temperature of 25° C. and shear rate of 5.11 $s^{-1}$. Yield stress and viscosity of the treatment fluid are evaluated at 25° C. in a Fann 35 rheometer with an R1B5F1 spindle, or an equivalent rheometer/spindle arrangement, with shear rate ramped up to 255 $s^{-1}$ (300 rpm) and back down to 0, an average of the two readings at 2.55, 5.11, 85.0, 170 and 255 $s^{-1}$ (3, 6, 100, 200 and 300 rpm) recorded as the respective shear stress, the apparent dynamic viscosity is determined as the ratio of shear stress to shear rate ($\tau/\gamma$) at $\gamma$=170 $s^{-1}$, and the yield stress ($\tau_0$) (if any) is determined as the y-intercept using a best fit of the Herschel-Buckley rheological model, $\tau=\tau_0+k(\gamma)^n$, where $\tau$ is the shear stress, k is a constant, $\gamma$ is the shear rate and n is the power law exponent. Where the power law exponent is equal to 1, the Herschel-Buckley fluid is known as a Bingham plastic. Yield stress as used herein is synonymous with yield point and refers to the stress required to initiate flow in a Bingham plastic or Herschel-Buckley fluid system calculated as the y-intercept in the manner described herein. A "yield stress fluid" refers to a Herschel-Buckley fluid system, including Bingham plastics or another fluid system in which an applied non-zero stress as calculated in the manner described herein is required to initiate fluid flow.

The following conventions with respect to slurry terms are intended herein unless otherwise indicated explicitly or implicitly by context.

"Treatment fluid" or "fluid" (in context) refers to the entire treatment fluid, including any proppant, subproppant particles, liquid, gas etc. "Whole fluid," "total fluid" and "base fluid" are used herein to refer to the fluid phase plus any subproppant particles dispersed therein, but exclusive of proppant particles. "Carrier," "fluid phase" or "liquid phase" refer to the fluid or liquid that is present, which may comprise a continuous phase and optionally one or more discontinuous fluid phases dispersed in the continuous phase, including any solutes, thickeners or colloidal particles only, exclusive of other solid phase particles; reference to "water" in the slurry refers only to water and excludes any particles, solutes, thickeners, colloidal particles, etc.; reference to "aqueous phase" refers to a carrier phase comprised predominantly of water, which may be a continuous or dispersed phase. As used herein the terms "liquid" or "liquid phase" encompasses both liquids per se and supercritical fluids, including any solutes dissolved therein.

The measurement or determination of the viscosity of the liquid phase (as opposed to the treatment fluid or base fluid) may be based on a direct measurement of the solids-free liquid, or a calculation or correlation based on a measurement(s) of the characteristics or properties of the liquid containing the solids, or a measurement of the solids-containing liquid using a technique where the determination of viscosity is not affected by the presence of the solids. As used herein, solids-free for the purposes of determining the viscosity of the liquid phase means in the absence of non-colloidal particles larger than 1 micron such that the particles do not affect the viscosity determination, but in the presence of any submicron or colloidal particles that may be present to thicken and/or form a gel with the liquid, i.e., in the presence of ultrafine particles that can function as a thickening agent. In some embodiments, a "low viscosity liquid phase" means a viscosity less than about 300 mPa-s measured without any solids greater than 1 micron at 170 $s^{-1}$ and 25° C.

In some embodiments, the treatment fluid may include a continuous fluid phase, also referred to as an external phase, and a discontinuous phase(s), also referred to as an internal phase(s), which may be a fluid (liquid or gas) in the case of an emulsion, foam or energized fluid, or which may be a solid in the case of a slurry. The continuous fluid phase may be any matter that is substantially continuous under a given condition. Examples of the continuous fluid phase include, but are not limited to, water, hydrocarbon, gas, liquefied gas, etc., which may include solutes, e.g. the fluid phase may be a brine, and/or may include a brine or other solution(s). In some embodiments, the fluid phase(s) may optionally include a viscosifying and/or yield point agent and/or a portion of the total amount of viscosifying and/or yield point agent present. Some non-limiting examples of the fluid phase(s) include hydratable gels (e.g. gels containing polysaccharides such as guars, xanthan and diutan, hydroxyethylcellulose, polyvinyl alcohol, other hydratable polymers, colloids, etc.), a cross-linked hydratable gel, a viscosified acid (e.g. gel-based), an emulsified acid (e.g. oil outer phase), an energized fluid (e.g., an $N_2$ or $CO_2$ based foam), a viscoelastic surfactant (VES) viscosified fluid, and an oil-based fluid including a gelled, foamed, or otherwise viscosified oil.

The discontinuous phase if present in the treatment fluid may be any particles (including fluid droplets) that are suspended or otherwise dispersed in the continuous phase in a disjointed manner. In this respect, the discontinuous phase can also be referred to, collectively, as "particle" or "particulate" which may be used interchangeably. As used herein, the term "particle" should be construed broadly. For example, in some embodiments, the particle(s) of the current application are solid such as proppant, sands, ceramics, crystals, salts, etc.; however, in some other embodiments, the particle(s) can be liquid, gas, foam, emulsified droplets, etc. Moreover, in some embodiments, the particle(s) of the current application are substantially stable and do not change shape or form over an extended period of time, temperature, or pressure; in some other embodiments, the particle(s) of the current application are degradable, dissolvable, deformable, meltable, sublimeable, or otherwise capable of being changed in shape, state, or structure.

In certain embodiments, the particle(s) is substantially round and spherical. In some certain embodiments, the particle(s) is not substantially spherical and/or round, e.g., it can have varying degrees of sphericity and roundness, according to the API RP-60 sphericity and roundness index. For example, the particle(s) may have an aspect ratio, defined as the ratio of the longest dimension of the particle to the shortest dimension of the particle, of more than 2, 3, 4, 5 or 6. Examples of such non-spherical particles include, but are not limited to, fibers, flakes, discs, rods, stars, etc. All such variations should be considered within the scope of the current application.

The particles in the slurry in various embodiments may be multimodal. As used herein multimodal refers to a plurality of particle sizes or modes which each has a distinct size or particle size distribution, e.g., proppant and fines. As used herein, the terms distinct particle sizes, distinct particle size distribution, or multi-modes or multimodal, mean that each of the plurality of particles has a unique volume-averaged particle size distribution (PSD) mode. That is, statistically, the particle size distributions of different particles appear as distinct peaks (or "modes") in a continuous probability distribution function. For example, a mixture of two particles having normal distribution of particle sizes with similar variability is considered a bimodal particle mixture if their respective means differ by more than the sum of their respective standard deviations, and/or if their respective means differ by a statistically significant amount. In certain embodiments, the particles contain a bimodal mixture of two particles; in certain other embodiments, the particles contain a trimodal mixture of three particles; in certain additional embodiments, the particles contain a tetramodal mixture of four particles; in certain further embodiments, the particles contain a pentamodal mixture of five particles, and so on. Representative references disclosing multimodal particle mixtures include U.S. Pat. No. 5,518,996, U.S. Pat. No. 7,784,541, U.S. Pat. No. 7,789,146, U.S. Pat. No. 8,008,234, U.S. Pat. No. 8,119,574, U.S. Pat. No. 8,210,249, US 2010/0300688, US 2012/0000641, US 2012/0138296, US 2012/0132421, US 2012/0111563, WO 2012/054456, US 2012/0305245, US 2012/0305254, US 2012/0132421, PCT/RU2011/000971 and U.S. Ser. No. 13/415,025, each of which are hereby incorporated herein by reference.

"Solids" and "solids volume" refer to all solids present in the slurry, including proppant and subproppant particles, including particulate thickeners such as colloids and submicron particles. "Solids-free" and similar terms generally exclude proppant and subproppant particles, except particulate thickeners such as colloids for the purposes of determining the viscosity of a "solids-free" fluid. "Proppant" refers to particulates that are used in well work-overs and treatments, such as hydraulic fracturing operations, to hold fractures open following the treatment, of a particle size mode or modes in the slurry having a weight average mean particle size greater than or equal to about 100 microns, e.g., 140 mesh particles correspond to a size of 105 microns, unless a different proppant size is indicated in the claim or a smaller proppant size is indicated in a claim depending therefrom. "Gravel" refers to particles used in gravel packing, and the term is synonymous with proppant as used herein. "Sub-proppant" or "subproppant" refers to particles or particle size or mode (including colloidal and submicron particles) having a smaller size than the proppant mode(s); references to "proppant" exclude subproppant particles and vice versa. In some embodiments, the sub-proppant mode or modes each have a weight average mean particle size less than or equal to about one-half of the weight average mean particle size of a smallest one of the proppant modes, e.g., a suspensive/stabilizing mode.

The proppant, when present, can be naturally occurring materials, such as sand grains. The proppant, when present, can also be man-made or specially engineered, such as coated (including resin-coated) sand, modulus of various nuts, high-strength ceramic materials like sintered bauxite, etc. In some embodiments, the proppant of the current application, when present, has a density greater than 2.45 g/mL, e.g., 2.5-2.8 g/mL, such as sand, ceramic, sintered bauxite or resin coated proppant. In some embodiments, the proppant of the current application, when present, has a density less than or equal to 2.45 g/mL, such as less than about 1.60 g/mL, less than about 1.50 g/mL, less than about 1.40 g/mL, less than about 1.30 g/mL, less than about 1.20 g/mL, less than 1.10 g/mL, or less than 1.00 g/mL, such as light/ultralight proppant from various manufacturers, e.g., hollow proppant.

In some embodiments, the treatment fluid comprises an apparent specific gravity greater than 1.3, greater than 1.4, greater than 1.5, greater than 1.6, greater than 1.7, greater than 1.8, greater than 1.9, greater than 2, greater than 2.1, greater than 2.2, greater than 2.3, greater than 2.4, greater than 2.5, greater than 2.6, greater than 2.7, greater than 2.8, greater than 2.9, or greater than 3. The treatment fluid density can be selected by selecting the specific gravity and amount of the dispersed solids and/or adding a weighting solute to the aqueous phase, such as, for example, a compatible organic or mineral salt. In some embodiments, the aqueous or other liquid phase may have a specific gravity greater than 1, greater than 1.05, greater than 1.1, greater than 1.2, greater than 1.3, greater than 1.4, greater than 1.5, greater than 1.6, greater than 1.7, greater than 1.8, greater than 1.9, greater than 2, greater than 2.1, greater than 2.2, greater than 2.3, greater than 2.4, greater than 2.5, greater than 2.6, greater than 2.7, greater than 2.8, greater than 2.9, or greater than 3, etc. In some embodiments, the aqueous or other liquid phase may have a specific gravity less than 1. In embodiments, the weight of the treatment fluid can provide additional hydrostatic head pressurization in the wellbore at the perforations or other fracture location, and can also facilitate stability by lessening the density differences between the larger solids and the whole remaining fluid. In other embodiments, a low density proppant may be used in the treatment, for example, lightweight proppant (apparent specific gravity less than 2.65) having a density less than or equal to 2.5 g/mL, such as less than about 2 g/mL, less than about 1.8 g/mL, less than about 1.6 g/mL, less than about 1.4 g/mL, less than about 1.2 g/mL, less than 1.1 g/mL, or less than 1 g/mL. In other embodiments, the proppant or other particles in the slurry may have a specific gravity greater than 2.6, greater than 2.7, greater than 2.8, greater than 2.9, greater than 3, etc.

"Stable" or "stabilized" or similar terms refer to a stabilized treatment slurry (STS) wherein gravitational settling of the particles is inhibited such that no or minimal free liquid is formed, and/or there is no or minimal rheological variation among strata at different depths in the STS, and/or the slurry may generally be regarded as stable over the duration of expected STS storage and use conditions, e.g., an STS that passes a stability test or an equivalent thereof. In certain embodiments, stability can be evaluated following different settling conditions, such as for example static under gravity alone, or dynamic under a vibratory influence, or dynamic-static conditions employing at least one dynamic settling condition followed and/or preceded by at least one static settling condition.

The static settling test conditions can include gravity settling for a specified period, e.g., 24 hours, 48 hours, 72 hours, or the like, which are generally referred to with the respective shorthand notation "24 h-static", "48 h-static" or "72 h-static". Dynamic settling test conditions generally indicate the vibratory frequency and duration, e.g., 4 h@15 Hz (4 hours at 15 Hz), 8 h@5 Hz (8 hours at 5 Hz), or the like. Dynamic settling test conditions are at a vibratory amplitude of 1 mm vertical displacement unless otherwise indicated. Dynamic-static settling test conditions will indicate the settling history preceding analysis including the total duration of vibration and the final period of static conditions, e.g., 4 h@15 Hz/20 h-static refers to 4 hours vibration followed by 20 hours static, or 8 h@15 Hz/10 d-static refers to 8 hours total vibration, e.g., 4 hours vibration followed by 20 hours static followed by 4 hours vibration, followed by 10 days of static conditions. In the absence of a contrary indication, the designation "8 h@15 Hz/10 d-static" refers to the test conditions of 4 hours vibration, followed by 20 hours static followed by 4 hours vibration, followed by 10 days of static conditions. In the absence of specified settling conditions, the settling condition is 72 hours static. The stability settling and test conditions are at 25° C. unless otherwise specified.

In certain embodiments, one stability test is referred to herein as the "8 h@15 Hz/10 d-static STS stability test", wherein a slurry sample is evaluated in a rheometer at the beginning of the test and compared against different strata of a slurry sample placed and sealed in a 152 mm (6 in.) diameter vertical gravitational settling column filled to a depth of 2.13 m (7 ft), vibrated at 15 Hz with a 1 mm amplitude (vertical displacement) two 4-hour periods the first and second settling days, and thereafter maintained in a static condition for 10 days (12 days total settling time). The 15 Hz/1 mm amplitude condition in this test is selected to correspond to surface transportation and/or storage conditions prior to the well treatment. At the end of the settling period the depth of any free water at the top of the column is measured, and samples obtained, in order from the top sampling port down to the bottom, through 25.4-mm sampling ports located on the settling column at 190 mm (6'3"), 140 mm (4'7"), 84 mm (2'9") and 33 mm (1'1"), and rheologically evaluated for viscosity and yield stress as described above.

As used herein, a stabilized treatment slurry (STS) may meet at least one of the following conditions:

(1) the slurry has a low-shear viscosity equal to or greater than 1 Pa-s (5.11 $s^{-1}$, 25° C.);

(2) the slurry has a Herschel-Buckley (including Bingham plastic) yield stress (as determined in the manner described herein) equal to or greater than 1 Pa; or (3) the largest particle mode in the slurry has a static settling rate less than 0.01 mm/hr; or (4) the depth of any free fluid at the end of a 72-hour static settling test condition or an 8 h@15 Hz/10 d-static dynamic settling test condition (4 hours vibration followed by 20 hours static followed by 4 hours vibration followed finally by 10 days of static conditions) is no more than 2% of total depth; or (5) the apparent dynamic viscosity (25° C., 170 $s^{-1}$) across column strata after the 72-hour static settling test condition or the 8 h@15 Hz/10 d-static dynamic settling test condition is no more than +/−20% of the initial dynamic viscosity; or (6) the slurry solids volume fraction (SVF) across the column strata below any free water layer after the 72-hour static settling test condition or the 8 h@15 Hz/10 d-static dynamic settling test condition is no more than 5% greater than the initial SVF; or (7) the density across the column strata below any free water layer after the 72-hour static settling test condition or the 8 h@15 Hz/10 d-static dynamic settling test condition is no more than 1% of the initial density.

In embodiments, the depth of any free fluid at the end of the 8 h@15 Hz/10 d-static dynamic settling test condition is no more than 2% of total depth, the apparent dynamic viscosity (25° C., 170 s−1) across column strata after the 8 h@15 Hz/10 d-static dynamic settling test condition is no more than +/−20% of the initial dynamic viscosity, the slurry solids volume fraction (SVF) across the column strata below any free water layer after the 8 h@15 Hz/10 d-static dynamic settling test condition is no more than 5% greater than the initial SVF, and the density across the column strata below any free water layer after the 8 h@15 Hz/10 d-static dynamic settling test condition is no more than 1% of the initial density.

In some embodiments, the treatment slurry comprises at least one of the following stability indicia: (1) an SVF of at least 0.4 up to SVF=PVF; (2) a low-shear viscosity of at least 1 Pa-s (5.11 $s^{-1}$, 25° C.); (3) a yield stress (as determined herein) of at least 1 Pa; (4) an apparent viscosity of at least 50 mPa-s (170 $s^{-1}$, 25° C.); (5) a multimodal solids phase; (6) a solids phase having a PVF greater than 0.7; (7) a viscosifier selected from viscoelastic surfactants, in an amount ranging from 0.01 up to 7.2 g/L (60 ppt), and hydratable gelling agents in an amount ranging from 0.01 up to 4.8 g/L (40 ppt) based on the volume of fluid phase; (8) colloidal particles; (9) a particle-fluid density delta less than 1.6 g/mL, (e.g., particles having a specific gravity less than 2.65 g/mL, carrier fluid having a density greater than 1.05 g/mL or a combination thereof); (10) particles having an aspect ratio of at least 6; (11) ciliated or coated proppant; and (12) combinations thereof.

In some embodiments, the stabilized slurry comprises at least two of the stability indicia, such as for example, the SVF of at least 0.4 and the low-shear viscosity of at least 1 Pa-s (5.11 $s^{-1}$, 25° C.); and optionally one or more of the yield stress of at least 1 Pa, the apparent viscosity of at least 50 mPa-s (170 $s^{-1}$, 25° C.), the multimodal solids phase, the solids phase having a PVF greater than 0.7, the viscosifier, the colloidal particles, the particle-fluid density delta less than 1.6 g/mL, the particles having an aspect ratio of at least 6, the ciliated or coated proppant, or a combination thereof.

In some embodiments, the stabilized slurry comprises at least three of the stability indicia, such as for example, the SVF of at least 0.4, the low-shear viscosity of at least 1 Pa-s (5.11 $s^{-1}$, 25° C.) and the yield stress of at least 1 Pa; and optionally one or more of the apparent viscosity of at least 50 mPa-s (170 $s^{-1}$, 25° C.), the multimodal solids phase, the solids phase having a PVF greater than 0.7, the viscosifier, the colloidal particles, the particle-fluid density delta less than 1.6 g/mL, the particles having an aspect ratio of at least 6, the ciliated or coated proppant, or a combination thereof.

In some embodiments, the stabilized slurry comprises at least four of the stability indicia, such as for example, the SVF of at least 0.4, the low-shear viscosity of at least 1 Pa-s (5.11 $s^{-1}$, 25° C.), the yield stress of at least 1 Pa and the apparent viscosity of at least 50 mPa-s (170 $s^{-1}$, 25° C.); and optionally one or more of the multimodal solids phase, the solids phase having a PVF greater than 0.7, the viscosifier, colloidal particles, the particle-fluid density delta less than 1.6 g/mL, the particles having an aspect ratio of at least 6, the ciliated or coated proppant, or a combination thereof.

In some embodiments, the stabilized slurry comprises at least five of the stability indicia, such as for example, the SVF of at least 0.4, the low-shear viscosity of at least 1 Pa-s (5.11 $s^{-1}$, 25° C.), the yield stress of at least 1 Pa, the apparent viscosity of at least 50 mPa-s (170 $s^{-1}$, 25° C.) and the multimodal solids phase, and optionally one or more of the solids phase having a PVF greater than 0.7, the viscosifier, colloidal particles, the particle-fluid density delta less than 1.6 g/mL, the particles having an aspect ratio of at least 6, the ciliated or coated proppant, or a combination thereof.

In some embodiments, the stabilized slurry comprises at least six of the stability indicia, such as for example, the SVF of at least 0.4, the low-shear viscosity of at least 1 Pa-s (5.11 $s^{-1}$, 25° C.), the yield stress of at least 1 Pa, the apparent viscosity of at least 50 mPa-s (170 $s^{-1}$, 25° C.), the multimodal solids phase and one or more of the solids phase having a PVF greater than 0.7, and optionally the viscosifier, colloidal particles, the particle-fluid density delta less than 1.6 g/mL, the particles having an aspect ratio of at least 6, the ciliated or coated proppant, or a combination thereof.

In embodiments, the treatment slurry is formed (stabilized) by at least one of the following slurry stabilization operations: (1) introducing sufficient particles into the slurry or treatment fluid to increase the SVF of the treatment fluid to at least 0.4; (2) increasing a low-shear viscosity of the slurry or treatment fluid to at least 1 Pa-s (5.11 $s^{-1}$, 25° C.); (3) increasing a yield stress of the slurry or treatment fluid to at least 1 Pa; (4) increasing apparent viscosity of the slurry or treatment fluid to at least 50 mPa-s (170 $s^{-1}$, 25° C.); (5) introducing a multimodal solids phase into the slurry or treatment fluid; (6) introducing a solids phase having a PVF greater than 0.7 into the slurry or treatment fluid; (7) introducing into the slurry or treatment fluid a viscosifier selected from viscoelastic surfactants, e.g., in an amount ranging from 0.01 up to 7.2 g/L (60 ppt), and hydratable gelling agents, e.g., in an amount ranging from 0.01 up to 4.8 g/L (40 ppt) based on the volume of fluid phase; (8) introducing colloidal particles into the slurry or treatment fluid; (9) reducing a particle-fluid density delta to less than 1.6 g/mL (e.g., introducing particles having a specific gravity less than 2.65 g/mL, carrier fluid having a density greater than 1.05 g/mL or a combination thereof); (10) introducing particles into the slurry or treatment fluid having an aspect ratio of at least 6; (11) introducing ciliated or coated proppant into slurry or treatment fluid; and (12) combinations thereof. The slurry stabilization operations may be separate or concurrent, e.g., introducing a single viscosifier may also increase low-shear viscosity, yield stress, apparent viscosity, etc., or alternatively or additionally with respect to a viscosifier, separate agents may be added to increase low-shear viscosity, yield stress and/or apparent viscosity.

The techniques to stabilize particle settling in various embodiments herein may use any one, or a combination of any two or three, or all of these approaches, i.e., a manipulation of particle/fluid density, carrier fluid viscosity, solids fraction, yield stress, and/or may use another approach. In embodiments, the stabilized slurry is formed by at least two of the slurry stabilization operations, such as, for example, increasing the SVF and increasing the low-shear viscosity of the treatment fluid, and optionally one or more of increasing the yield stress, increasing the apparent viscosity, introducing the multimodal solids phase, introducing the solids phase having the PVF greater than 0.7, introducing the viscosifier, introducing the colloidal particles, reducing the particle-fluid density delta, introducing the particles having the aspect ratio of at least 6, introducing the ciliated or coated proppant or a combination thereof.

In embodiments, the stabilized slurry is formed by at least three of the slurry stabilization operations, such as, for example, increasing the SVF, increasing the low-shear viscosity and introducing the multimodal solids phase, and optionally one or more of increasing the yield stress, increasing the apparent viscosity, introducing the solids phase having the PVF greater than 0.7, introducing the viscosifier, introducing the colloidal particles, reducing the particle-fluid density delta, introducing the particles having the aspect ratio of at least 6, introducing the ciliated or coated proppant or a combination thereof.

In embodiments, the stabilized slurry is formed by at least four of the slurry stabilization operations, such as, for example, increasing the SVF, increasing the low-shear viscosity, increasing the yield stress and increasing apparent viscosity, and optionally one or more of introducing the multimodal solids phase, introducing the solids phase having the PVF greater than 0.7, introducing the viscosifier, introducing colloidal particles, reducing the particle-fluid density delta, introducing particles into the treatment fluid having the aspect ratio of at least 6, introducing the ciliated or coated proppant or a combination thereof.

In embodiments, the stabilized slurry is formed by at least five of the slurry stabilization operations, such as, for example, increasing the SVF, increasing the low-shear viscosity, increasing the yield stress, increasing the apparent viscosity and introducing the multimodal solids phase, and optionally one or more of introducing the solids phase having the PVF greater than 0.7, introducing the viscosifier, introducing colloidal particles, reducing the particle-fluid density delta, introducing particles into the treatment fluid having the aspect ratio of at least 6, introducing the ciliated or coated proppant or a combination thereof.

Decreasing the density difference between the particle and the carrier fluid may be done in embodiments by employing porous particles, including particles with an internal porosity, i.e., hollow particles. However, the porosity may also have a direct influence on the mechanical properties of the particle, e.g., the elastic modulus, which may also decrease significantly with an increase in porosity. In certain embodiments employing particle porosity, care should be taken so that the crush strength of the particles exceeds the maximum expected stress for the particle, e.g., in the embodiments of proppants placed in a fracture the overburden stress of the subterranean formation in which it is to be used should not exceed the crush strength of the proppants.

In embodiments, yield stress fluids, and also fluids having a high low-shear viscosity, are used to retard the motion of the carrier fluid and thus retard particle settling. The gravitational stress exerted by the particle at rest on the fluid beneath it must generally exceed the yield stress of the fluid to initiate fluid flow and thus settling onset. For a single particle of density 2.7 g/mL and diameter of 600 settling in a yield stress fluid phase of 1 g/mL, the critical fluid yield stress, i.e., the minimum yield stress to prevent settling onset, in this example is 1 Pa. The critical fluid yield stress might be higher for larger particles, including particles with size enhancement due to particle clustering, aggregation or the like.

Increasing carrier fluid viscosity in a Newtonian fluid also proportionally increases the resistance of the carrier fluid motion. In some embodiments, the fluid carrier has a lower limit of apparent dynamic viscosity, determined at 170 $s^{-1}$ and 25° C., of at least about 0.1 mPa-s, or at least about 1 mPa-s, or at least about 10 mPa-s, or at least about 25 mPa-s, or at least about 50 mPa-s, or at least about 75 mPa-s, or at least about 100 mPa-s, or at least about 150 mPa-s. A disadvantage of increasing the viscosity is that as the viscosity increases, the friction pressure for pumping the slurry generally increases as well. In some embodiments, the fluid carrier has an upper limit of apparent dynamic viscosity, determined at 170 $s^{-1}$ and 25° C., of less than about 300 mPa-s, or less than about 150 mPa-s, or less than about 100 mPa-s, or less than about 75 mPa-s, or less than about 50 mPa-s, or less than about 25 mPa-s, or less than about 10 mPa-s. In embodiments, the fluid phase viscosity ranges from any lower limit to any higher upper limit.

In some embodiments, an agent may both viscosify and impart yield stress characteristics, and in further embodiments may also function as a friction reducer to reduce friction pressure losses in pumping the treatment fluid. In embodiments, the liquid phase is essentially free of viscosifier or comprises a viscosifier in an amount ranging from 0.01 up to 2.4 g/L (0.08-20 lb/1000 gals) of the fluid phase. The viscosifier can be a viscoelastic surfactant (VES) or a hydratable gelling agent such as a polysaccharide, which may be crosslinked. When using viscosifiers and/or yield stress fluids, it may be useful to consider the need for and if necessary implement a clean-up procedure, i.e., removal or inactivation of the viscosifier and/or yield stress fluid during or following the treatment procedure, since fluids with viscosifiers and/or yield stresses may present clean up difficulties in some situations or if not used correctly. In certain embodiments, clean up can be effected using a breaker(s). In some embodiments, the slurry is stabilized for storage and/or pumping or other use at the surface conditions, and clean-up is achieved downhole at a later time and at a higher temperature, e.g., for some formations, the temperature difference between surface and downhole can be significant and useful for triggering degradation of the viscosifier, the particles, a yield stress agent or characteristic, and/or a breaker. Thus in some embodiments, breakers that are either temperature sensitive or time sensitive, either through delayed action breakers or delay in mixing the breaker into the slurry, can be useful.

In certain embodiments, the fluid may be stabilized by introducing colloidal particles into the treatment fluid, such as, for example, colloidal silica, which may function as a gellant and/or thickener.

In addition or as an alternative to increasing the viscosity of the carrier fluid (with or without density manipulation), increasing the volume fraction of the particles in the treatment fluid can also hinder movement of the carrier fluid. Where the particles are not deformable, the particles interfere with the flow of the fluid around the settling particle to cause hindered settling. The addition of a large volume fraction of particles can be complicated, however, by increasing fluid viscosity and pumping pressure, and increasing the risk of loss of fluidity of the slurry in the event of carrier fluid losses. In some embodiments, the treatment fluid has a lower limit of apparent dynamic viscosity, determined at 170 $s^{-1}$ and 25° C., of at least about 1 mPa-s, or at least about 10 mPa-s, or at least about 25 mPa-s, or at least about 50 mPa-s, or at least about 75 mPa-s, or at least about 100 mPa-s, or at least about 150 mPa-s, or at least about 300 mPa-s, and an upper limit of apparent dynamic viscosity, determined at 170 $s^{-1}$ and 25° C., of less than about 500 mPa-s, or less than about 300 mPa-s, or less than about 150 mPa-s, or less than about 100 mPa-s, or less than about 75 mPa-s, or less than about 50 mPa-s, or less than about 25 mPa-s, or less than about 10 mPa-s. In embodiments, the treatment fluid viscosity ranges from any lower limit to any higher upper limit.

In embodiments, the treatment fluid may be stabilized by introducing sufficient particles into the treatment fluid to increase the SVF of the treatment fluid, e.g., to at least 0.5. In a powder or particulated medium, the packed volume fraction (PVF) is defined as the volume of space occupied by the particles (the absolute volume) divided by the bulk volume, i.e., the total volume of the particles plus the void space between them:

$$\text{PVF}=\text{Particle volume}/(\text{Particle volume}+\text{Non-particle Volume})=1-\phi$$

For the purposes of calculating PVF and slurry solids volume fraction (SVF) herein, the particle volume includes the volume of any colloidal and/or submicron particles.

Here, the porosity, $\phi$, is the void fraction of the powder pack. Unless otherwise specified the PVF of a particulated medium is determined in the absence of overburden or other compressive force that would deform the packed solids. The packing of particles (in the absence of overburden) is a purely geometrical phenomenon. Therefore, the PVF depends only on the size and the shape of particles. The most ordered arrangement of monodisperse spheres (spheres with exactly the same size in a compact hexagonal packing) has a PVF of 0.74. However, such highly ordered arrangements of particles rarely occur in industrial operations. Rather, a somewhat random packing of particles is prevalent in oilfield treatment. Unless otherwise specified, particle packing in the current application means random packing of the particles. A random packing of the same spheres has a PVF of 0.64. In other words, the randomly packed particles occupy 64% of the bulk volume, and the void space occupies 36% of the bulk volume. A higher PVF can be achieved by preparing blends of particles that have more than one particle size and/or a range(s) of particle sizes. The smaller particles can fit in the void spaces between the larger ones.

The PVF in embodiments can therefore be increased by using a multimodal particle mixture, for example, coarse, medium and fine particles in specific volume ratios, where the fine particles can fit in the void spaces between the medium-size particles, and the medium size particles can fit in the void space between the coarse particles. For some embodiments of two consecutive size classes or modes, the ratio between the mean particle diameters ($d_{50}$) of each mode may be between 7 and 10. In such cases, the PVF can increase up to 0.95 in some embodiments. By blending coarse particles (such as proppant) with other particles selected to increase the PVF, only a minimum amount of fluid phase (such as water) is needed to render the treatment fluid pumpable. Such concentrated suspensions (i.e. slurry) tend to behave as a porous solid and may shrink under the force of gravity. This is a hindered settling phenomenon as discussed above and, as mentioned, the extent of solids-like behavior generally increases with the slurry solid volume fraction (SVF), which is given as SVF=Particle volume/(Particle volume+Liquid volume)

It follows that proppant or other large particle mode settling in multimodal embodiments can if desired be minimized independently of the viscosity of the continuous phase. Therefore, in some embodiments little or no viscosifier and/or yield stress agent, e.g., a gelling agent, is required to inhibit settling and achieve particle transport, such as, for example, less than 2.4 g/L, less than 1.2 g/L, less than 0.6 g/L, less than 0.3 g/L, less than 0.15 g/L, less than 0.08 g/L, less than 0.04 g/L, less than 0.2 g/L or less than 0.1 g/L of viscosifier may be present in the STS.

It is helpful for an understanding of the current application to consider the amounts of particles present in the slurries of various embodiments of the treatment fluid. The minimum amount of fluid phase necessary to make a homogeneous slurry blend is the amount required to just fill all the void space in the PVF with the continuous phase, i.e., when SVF=PVF. However, this blend may not be flowable since all the solids and liquid may be locked in place with no room for slipping and mobility. In flowable system embodiments, SVF may be lower than PVF, e.g., SVF/PVF≤0.99. In this condition, in a stabilized treatment slurry, essentially all the voids are filled with excess liquid to increase the spacing between particles so that the particles can roll or flow past each other. In some embodiments, the higher the PVF, the lower the SVF/PVF ratio should be to obtain a flowable slurry.

Figure 15:
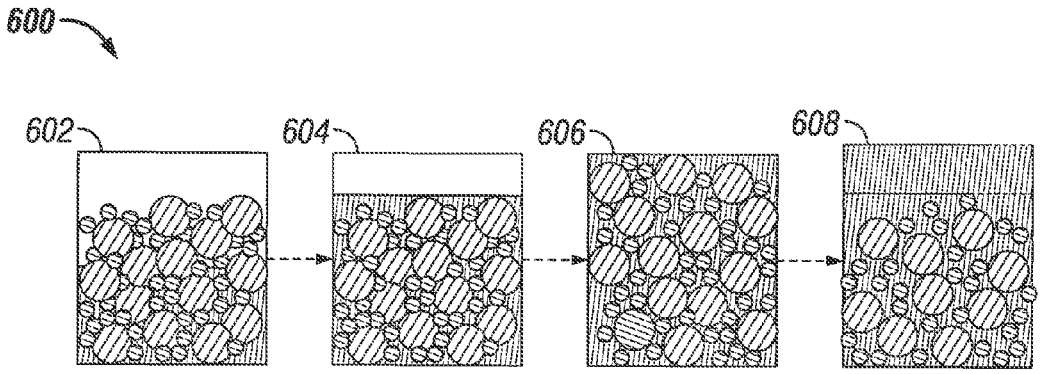
FIG. 15 shows a schematic slurry state progression chart for a treatment fluid according to some embodiments of the current application.

FIG. 15 shows a slurry state progression chart for a system 600 having a particle mix with added fluid phase. The first fluid 602 does not have enough liquid added to fill the pore spaces of the particles, or in other words the SVF/PVF is greater than 1.0. The first fluid 602 is not flowable. The second fluid 604 has just enough fluid phase to fill the pore spaces of the particles, or in other words the SVF/PVF is equal to 1.0. Testing determines whether the second fluid 604 is flowable and/or pumpable, but a fluid with an SVF/PVF of 1.0 is generally not flowable or barely flowable due to an excessive apparent viscosity and/or yield stress. The third fluid 606 has slightly more fluid phase than is required to fill the pore spaces of the particles, or in other words the SVF/PVF is just less than 1.0. A range of SVF/PVF values less than 1.0 will generally be flowable and/or pumpable or mixable, and if it does not contain too much fluid phase (and/or contains an added viscosifier) the third fluid 606 is stable. The values of the range of SVF/PVF values that are pumpable, flowable, mixable, and/or stable are dependent upon, without limitation, the specific particle mixture, fluid phase viscosity, the PVF of the particles, and the density of the particles. Simple laboratory testing of the sort ordinarily performed for fluids before fracturing treatments can readily determine the stability (e.g., the STS stability test as described herein) and flowability (e.g., apparent dynamic viscosity at 170 $s^{-1}$ and 25° C. of less than about 10,000 mPa-s).

The fourth fluid 608 shown in FIG. 15 has more fluid phase than the third fluid 606, to the point where the fourth fluid 608 is flowable but is not stabilized and settles, forming a layer of free fluid phase at the top (or bottom, depending upon the densities of the particles in the fourth fluid 608). The amount of free fluid phase and the settling time over which the free fluid phase develops before the fluid is considered unstable are parameters that depend upon the specific circumstances of a treatment, as noted above. For example, if the settling time over which the free liquid develops is greater than a planned treatment time, then in one example the fluid would be considered stable. Other factors, without limitation, that may affect whether a particular fluid remains stable include the amount of time for settling and flow regimes (e.g. laminar, turbulent, Reynolds number ranges, etc.) of the fluid flowing in a flow passage of interest or in an agitated vessel, e.g., the amount of time and flow regimes of the fluid flowing in the wellbore, fracture, etc., and/or the amount of fluid leakoff occurring in the wellbore, fracture, etc. A fluid that is stable for one fracturing treatment may be unstable for a second fracturing treatment. The determination that a fluid is stable at particular conditions may be an iterative determination based upon initial estimates and subsequent modeling results. In some embodiments, the stabilized treatment fluid passes the STS test described herein.

Figure 16:
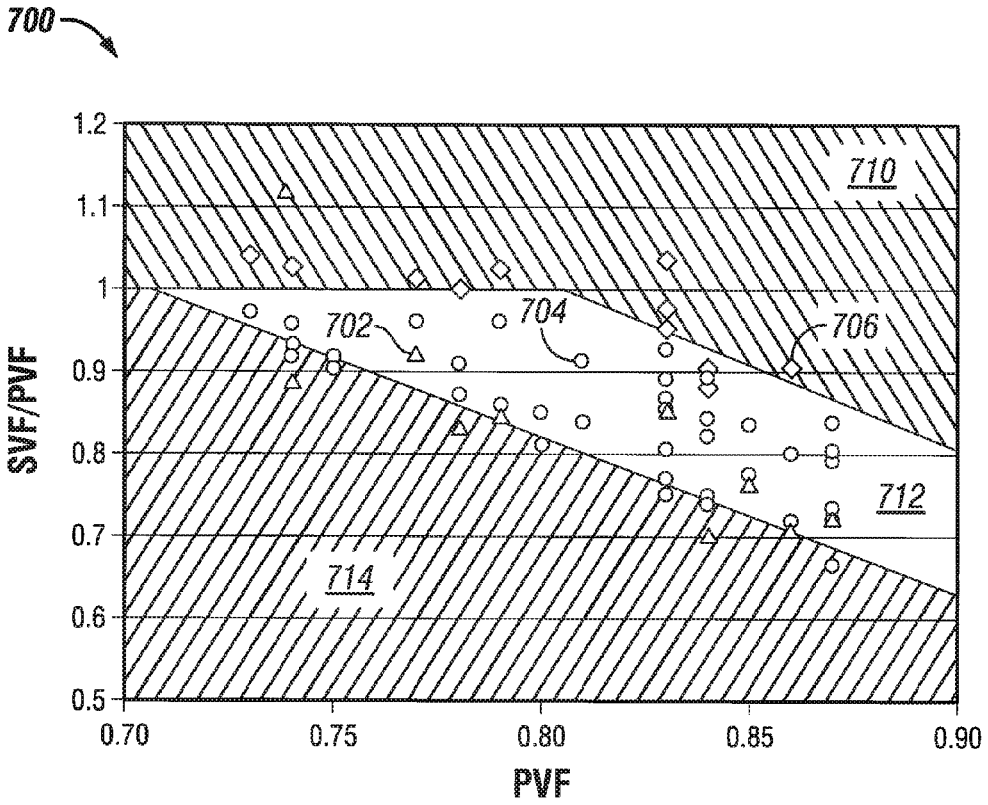
FIG. 16 illustrates fluid stability regions for a treatment fluid according to some embodiments of the current application.

FIG. 16 shows a data set 700 of various essentially Newtonian fluids without any added viscosifiers and without any yield stress, which were tested for the progression of slurry state on a plot of SVF/PVF as a function of PVF. The fluid phase in the experiments was water and the solids had specific gravity 2.6 g/mL. Data points 702 indicated with a triangle were values that had free water in the slurry, data points 704 indicated with a circle were slurriable fluids that were mixable without excessive free water, and data points 706 indicated with a diamond were not easily mixable liquid-solid mixtures. The data set 700 includes fluids prepared having a number of discrete PVF values, with liquid added until the mixture transitions from not mixable to a slurriable fluid, and then further progresses to a fluid having excess settling. At an example for a solids mixture with a PVF value near PVF=0.83, it was observed that around an SVF/PVF value of 0.95 the fluid transitions from an unmixable mixture to a slurriable fluid. At around an SVF/PVF of 0.7, the fluid transitions from a stable slurry to an unstable fluid having excessive settling. It can be seen from the data set 700 that the compositions can be defined approximately into a non-mixable region 710, a slurriable region 712, and a settling region 714.

FIG. 16 shows the useful range of SVF and PVF for slurries in embodiments without gelling agents. In some embodiments, the SVF is less than the PVF, or the ratio SVF/PVF is within the range from about 0.6 or about 0.65 to about 0.95 or about 0.98. Where the liquid phase has a viscosity less than 10 mPa-s or where the treatment fluid is water essentially free of thickeners, in some embodiments PVF is greater than 0.72 and a ratio of SVF/PVF is greater than about 1−2.1*(PVF−0.72) for stability (non-settling). Where the PVF is greater than 0.81, in some embodiments a ratio of SVF/PVF may be less than 1−2.1*(PVF−0.81) for mixability (flowability). Adding thickening or suspending agents, or solids that perform this function such as calcium carbonate or colloids, i.e., to increase viscosity and/or impart a yield stress, in some embodiments allows fluids otherwise in the settling area 714 embodiments (where SVF/PVF is less than or equal to about 1−2.1*(PVF−0.72)) to also be useful as an STS or in applications where a non-settling, slurriable/mixable slurry is beneficial, e.g., where the treatment fluid has a viscosity greater than 10 mPa-s, greater than 25 mPa-s, greater than 50 mPa-s, greater than 75 mPa-s, greater than 100 mPa-s, greater than 150 mPa-s, or greater than 300 mPa-s; and/or a yield stress greater than 0.1 Pa, greater than 0.5 Pa, greater than 1 Pa, greater than 10 Pa or greater than 20 Pa.

Introducing high-aspect ratio particles into the treatment fluid, e.g., particles having an aspect ratio of at least 6, represents additional or alternative embodiments for stabilizing the treatment fluid. Examples of such non-spherical particles include, but are not limited to, fibers, flakes, discs, rods, stars, etc., as described in, for example, U.S. Pat. No. 7,275,596, US20080196896, which are hereby incorporated herein by reference. In certain embodiments, introducing ciliated or coated proppant into the treatment fluid may stabilize or help stabilize the treatment fluid.

Proppant or other particles coated with a hydrophilic polymer can make the particles behave like larger particles and/or more tacky particles in an aqueous medium. The hydrophilic coating on a molecular scale may resemble ciliates, i.e., proppant particles to which hairlike projections have been attached to or formed on the surfaces thereof. Herein, hydrophilically coated proppant particles are referred to as "ciliated or coated proppant." Hydrophilically coated proppants and methods of producing them are described, for example, in WO 2011-050046, U.S. Pat. No. 5,905,468, U.S. Pat. No. 8,227,026 and U.S. Pat. No. 8,234,072, which are hereby incorporated herein by reference.

In some additional or alternative embodiment, the STS system may have the benefit that the smaller particles in the voids of the larger particles act as slip additives like mini-ball bearings, allowing the particles to roll past each other without any requirement for relatively large spaces between particles. This property can be demonstrated in some embodiments by the flow of the STS through a relatively small slot orifice with respect to the maximum diameter of the largest particle mode of the STS, e.g., a slot orifice less than 6 times the largest particle diameter, without bridging at the slot, i.e., the slurry flowed out of the slot has an SVF that is at least 90% of the SVF of the STS supplied to the slot. In contrast, the slickwater technique requires a ratio of perforation diameter to proppant diameter of at least 6, and additional enlargement for added safety to avoid screen out usually dictates a ratio of at least 8 or 10 and does not allow high proppant loadings.

In embodiments, the flowability of the STS through narrow flow passages such as perforations and fractures is similarly facilitated, allowing a smaller ratio of perforation diameter and/or fracture height to proppant size that still provides transport of the proppant through the perforation and/or to the tip of the fracture, i.e., improved flowability of the proppant in the fracture, e.g., in relatively narrow fracture widths, and improved penetration of the proppant-filled fracture extending away from the wellbore into the formation. These embodiments provide a relatively longer proppant-filled fracture prior to screenout relative to slickwater or high-viscosity fluid treatments.

As used herein, the "minimum slot flow test ratio" refers to a test wherein an approximately 100 mL slurry specimen is loaded into a fluid loss cell with a bottom slot opened to allow the test slurry to come out, with the fluid pushed by a piston using water or another hydraulic fluid supplied with an ISCO pump or equivalent at a rate of 20 mL/min, wherein a slot at the bottom of the cell can be adjusted to different openings at a ratio of slot width to largest particle mode diameter less than 6, and wherein the maximum slot flow test ratio is taken as the lowest ratio observed at which 50 vol % or more of the slurry specimen flows through the slot before bridging and a pressure increase to the maximum gauge pressure occurs. In some embodiments, the STS has a minimum slot flow test ratio less than 6, or less than 5, or less than 4, or less than 3, or a range of 2 to 6, or a range of 3 to 5.

Because of the relatively low water content (high SVF) of some embodiments of the STS, fluid loss from the STS may be a concern where flowability is important and SVF should at least be held lower than PVF, or considerably lower than PVF in some other embodiments. In conventional hydraulic fracturing treatments, there are two main reasons that a high volume of fluid and high amount of pumping energy have to be used, namely proppant transport and fluid loss. To carry the proppant to a distant location in a fracture, the treatment fluid has to be sufficiently turbulent (slickwater) or viscous (gelled fluid). Even so, only a low concentration of proppant is typically included in the treatment fluid to avoid settling and/or screen out. Moreover, when a fluid is pumped into a formation to initiate or propagate a fracture, the fluid pressure will be higher than the formation pressure, and the liquid in the treatment fluid is constantly leaking off into the formation. This is especially the case for slickwater operations. The fracture creation is a balance between the fluid loss and new volume created. As used herein, "fracture creation" encompasses either or both the initiation of fractures and the propagation or growth thereof. If the liquid injection rate is lower than the fluid loss rate, the fracture cannot be grown and becomes packed off. Therefore, traditional hydraulic fracturing operations are not efficient in creating fractures in the formation.

In some embodiments of the STS herein where the SVF is high, even a small loss of carrier fluid may result in a loss of flowability of the treatment fluid, and in some embodiments it is therefore undertaken to guard against excessive fluid loss from the treatment fluid, at least until the fluid and/or proppant reaches its ultimate destination. In embodiments, the STS may have an excellent tendency to retain fluid and thereby maintain flowability, i.e., it has a low leakoff rate into a porous or permeable surface with which it may be in contact. According to some embodiments of the current application, the treatment fluid is formulated to have very good leakoff control characteristics, i.e., fluid retention to maintain flowability. The good leak control can be achieved by including a leakoff control system in the treatment fluid of the current application, which may comprise one or more of high viscosity, low viscosity, a fluid loss control agent, selective construction of a multi-modal particle system in a multimodal fluid (MMF) or in a stabilized multimodal fluid (SMMF), or the like, or any combination thereof.

Figure 12:
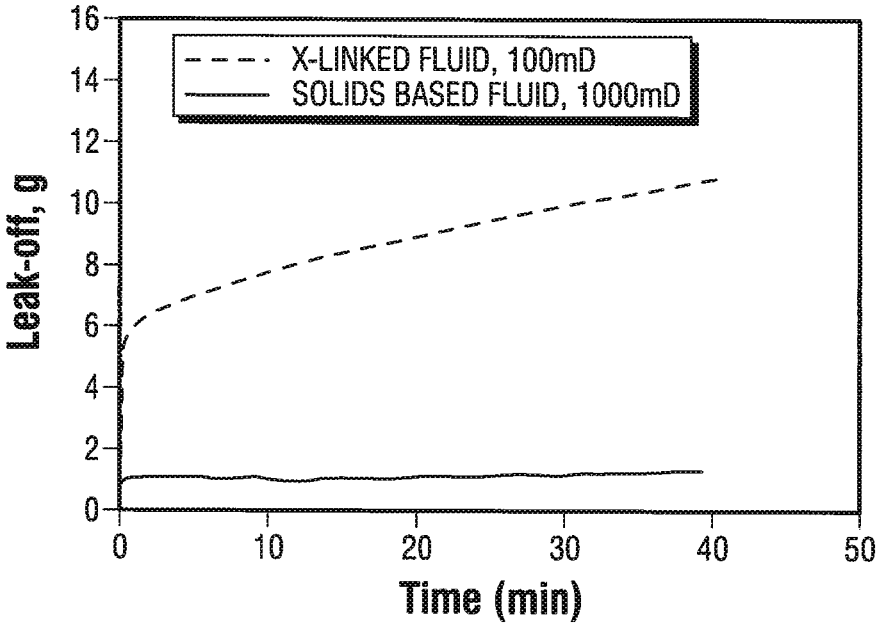
FIG. 12 shows the leakoff property of a low viscosity, high proppant treatment fluid (lower line) according to some embodiments of the current application compared to conventional crosslinked fluid (upper line).

As discussed in the examples below and as shown in FIG. 12, the leakoff of embodiments of a treatment fluid of the current application was an order of magnitude less than that of a conventional crosslinked fluid. It should be noted that the leakoff characteristic of a treatment fluid is dependent on the permeability of the formation to be treated. Therefore, a treatment fluid that forms a low permeability filter cake with good leakoff characteristic for one formation may or may not be a treatment fluid with good leakoff for another formation. Conversely, certain embodiments of the treatment fluids of the current application form low permeability filter cakes that have substantially superior leakoff characteristics such that they are not dependent on the substrate permeability provided the substrate permeability is higher than a certain minimum, e.g., at least 1 mD.

In certain embodiments herein, the STS comprises a packed volume fraction (PVF) greater than a slurry solids volume fraction (SVF), and has a spurt loss value (Vspurt) less than 10 vol % of a fluid phase of the stabilized treatment fluid or less than 50 vol % of an excess fluid phase (Vspurt<0.50*(PVF−SVF), where the "excess fluid phase" is taken as the amount of fluid in excess of the amount present at the condition SVF=PVF, i.e., excess fluid phase=PVF−SVF).

In some embodiments the treatment fluid comprises an STS also having a very low leakoff rate. For example, the total leakoff coefficient may be about $3\times10^{-4}$ m/min$^{1/2}$ ($10^{-3}$ ft/min$^{1/2}$) or less, or about $3\times10^{-5}$ m/min$^{1/2}$ ($10^{-4}$ ft/min$^{1/2}$) or less. As used herein, Vspurt and the total leak-off coefficient Cw are determined by following the static fluid loss test and procedures set forth in Section 8-8.1, "Fluid loss under static conditions," in *Reservoir Stimulation,* 3rd Edition, Schlumberger, John Wiley & Sons, Ltd., pp. 8-23 to 8-24, 2000, in a filter-press cell using ceramic disks (FANN filter disks, part number 210538) saturated with 2% KCl solution and covered with filter paper and test conditions of ambient temperature (25° C.), a differential pressure of 3.45 MPa (500 psi), 100 ml sample loading, and a loss collection period of 60 minutes, or an equivalent testing procedure. In some embodiments of the current application, the treatment fluid has a fluid loss value of less than 10 g in 30 min when tested on a core sample with 1000 mD porosity. In some embodiments of the current application, the treatment fluid has a fluid loss value of less than 8 g in 30 min when tested on a core sample with 1000 mD porosity. In some embodiments of the current application, the treatment fluid has a fluid loss value of less than 6 g in 30 min when tested on a core sample with 1000 mD porosity. In some embodiments of the current application, the treatment fluid has a fluid loss value of less than 2 g in 30 min when tested on a core sample with 1000 mD porosity.

The unique low to no fluid loss property allows the treatment fluid to be pumped at a low rate or pumping stopped (static) with a low risk of screen out. In embodiments, the low fluid loss characteristic may be obtained by including a leak-off control agent, such as, for example, particulated loss control agents (in some embodiments less than 1 micron or 0.05-0.5 microns), graded PSD or multimodal particles, polymers, latex, fiber, etc. As used herein, the terms leak-off control agent, fluid loss control agent and similar refer to additives that inhibit fluid loss from the slurry into a permeable formation.

As representative leakoff control agents, which may be used alone or in a multimodal fluid, there may be mentioned latex dispersions, water soluble polymers, submicron particulates, particulates with an aspect ratio higher than 1, or higher than 6, combinations thereof and the like, such as, for example, crosslinked polyvinyl alcohol microgel. The fluid loss agent can be, for example, a latex dispersion of polyvinylidene chloride, polyvinyl acetate, polystyrene-co-butadiene; a water soluble polymer such as hydroxyethylcellulose (HEC), guar, copolymers of polyacrylamide and their derivatives; particulate fluid loss control agents in the size range of 30 nm to 1 micron, such as γ-alumina, colloidal silica, $CaCO_3$, $SiO_2$, bentonite etc.; particulates with different shapes such as glass fibers, flakes, films; and any combination thereof or the like. Fluid loss agents can if desired also include or be used in combination with acrylamido-methyl-propane sulfonate polymer (AMPS). In embodiments, the leak-off control agent comprises a reactive solid, e.g., a hydrolysable material such as PGA, PLA or the like; or it can include a soluble or solubilizable material such as a wax, an oil-soluble resin, or another material soluble in hydrocarbons, or calcium carbonate or another material soluble at low pH; and so on. In embodiments, the leak-off control agent comprises a reactive solid selected from ground quartz, oil soluble resin, degradable rock salt, clay, zeolite or the like. In other embodiments, the leak-off control agent comprises one or more of magnesium hydroxide, magnesium carbonate, magnesium calcium carbonate, calcium carbonate, aluminum hydroxide, calcium oxalate, calcium phosphate, aluminum metaphosphate, sodium zinc potassium polyphosphate glass, and sodium calcium magnesium polyphosphate glass, or the like.

The treatment fluid may additionally or alternatively include, without limitation, friction reducers, clay stabilizers, biocides, crosslinkers, breakers, corrosion inhibitors, and/or proppant flowback control additives. The treatment fluid may further include a product formed from degradation, hydrolysis, hydration, chemical reaction, or other process that occur during preparation or operation.

In certain embodiments herein, the STS may be prepared by combining the particles, such as proppant if present and subproppant, the carrier liquid and any additives to form a proppant-containing treatment fluid; and stabilizing the proppant-containing treatment fluid. The combination and stabilization may occur in any order or concurrently in single or multiple stages in a batch, semi-batch or continuous operation. For example, in some embodiments, the base fluid may be prepared from the subproppant particles, the carrier liquid and other additives, and then the base fluid combined with the proppant.

The treatment fluid may be prepared on location, e.g., at the wellsite when and as needed using conventional treatment fluid blending equipment.

Figure 13:
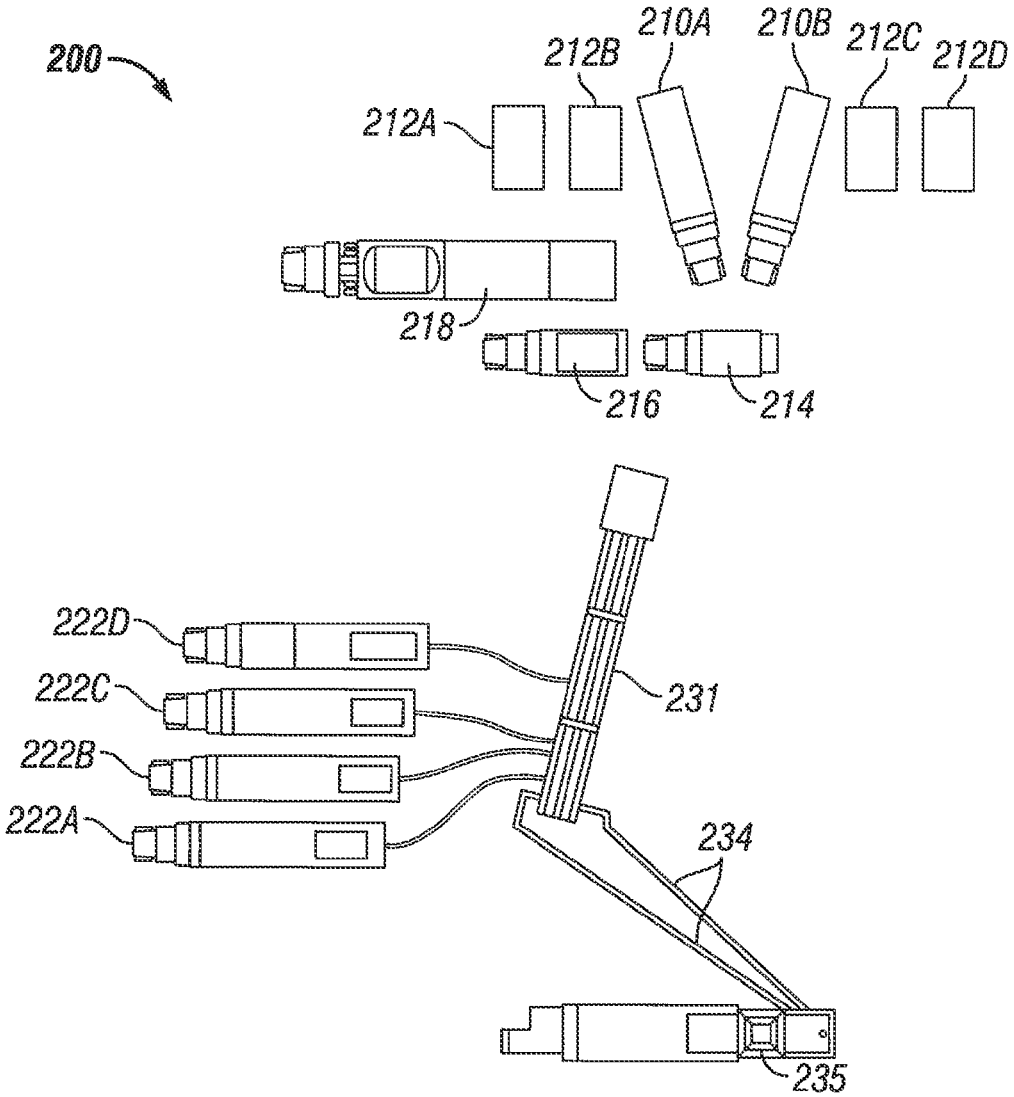
FIG. 13 shows a schematic representation of the wellsite equipment configuration with onsite mixing according to some embodiments of the current application.

FIG. 13 shows a wellsite equipment configuration 200 for a fracture treatment job according to some embodiments using the principles disclosed herein, for a land-based fracturing operation. The proppant is contained in sand trailers 210A, 210B. Water tanks 212A, 212B, 212C, 212D are arranged along one side of the operation site. Hopper 214 receives sand from the sand trailers 210A, 210B and distributes it into the mixer truck 216. Blender 218 is provided to blend the carrier medium (such as brine, viscosified fluids, etc.) with the proppant, i.e., "on the fly," and then the slurry is discharged to manifold 231. The final mixed and blended slurry, also called frac fluid, is then transferred to the pump trucks 222A, 222B, 222C, 222D, and routed at treatment pressure through treating line 234 to rig 235, and then pumped downhole. This configuration eliminates the additional mixer truck(s), pump trucks, blender(s), manifold(s) and line(s) normally required for slickwater fracturing operations, and the overall footprint is considerably reduced.

Figure 14:
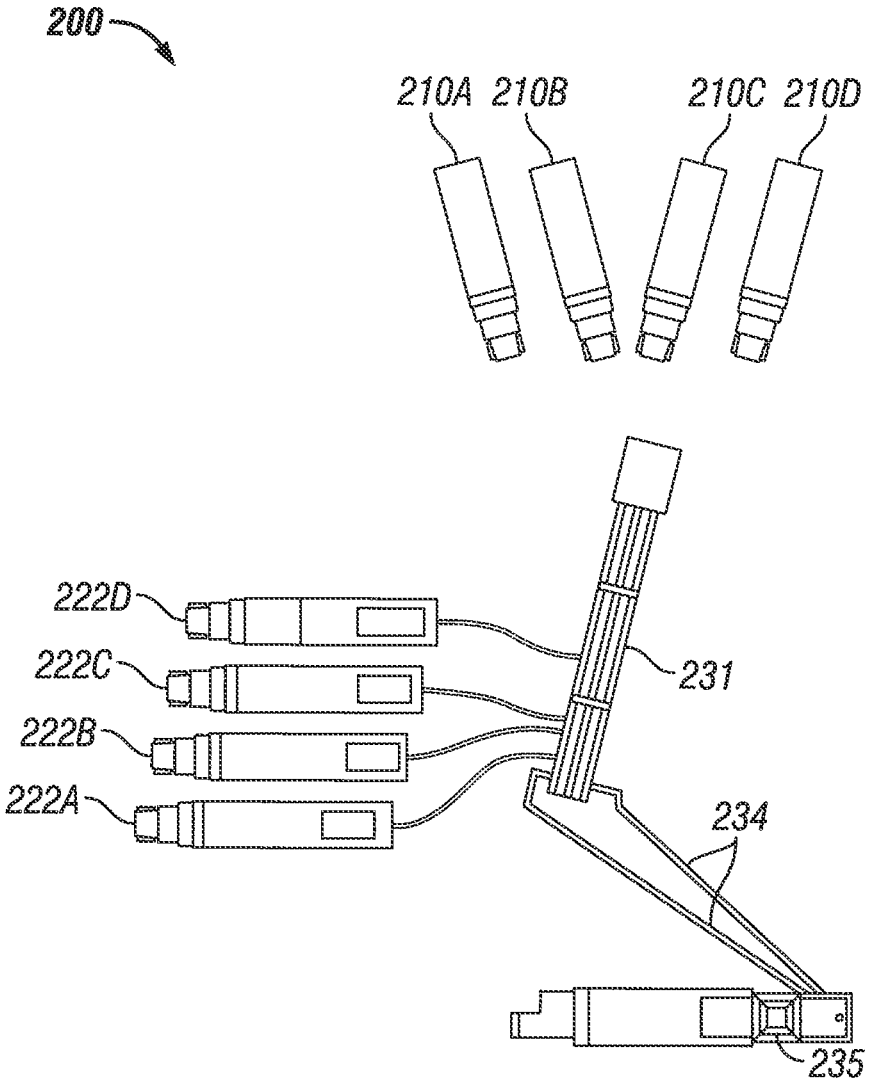
FIG. 14 shows a schematic representation of the wellsite equipment configuration with a pump-ready fluid according to some embodiments of the current application.

FIG. 14 shows further embodiments of the wellsite equipment configuration 200 with the additional feature of delivery of pump-ready treatment fluid delivered to the wellsite in trailers 210A to 210D and further elimination of the mixer 216, hopper 214, and/or blender 218. In some embodiments the treatment fluid is prepared offsite and pre-mixed with proppant and other additives, or with some or all of the additives except proppant, such as in a system described in co-pending co-assigned patent applications with application Ser. No. 13/415,025, filed on Mar. 8, 2012, and application Ser. No. 13/487,002, filed on Jun. 1, 2012, the entire contents of which are incorporated herein by reference in their entireties. As used herein, the term "pump-ready" should be understood broadly. In certain embodiments, a pump-ready treatment fluid means the treatment fluid is fully prepared and can be pumped downhole without being further processed. In some other embodiments, the pump-ready treatment fluid means the fluid is substantially ready to be pumped downhole except that a further dilution may be needed before pumping or one or more minor additives need to be added before the fluid is pumped downhole. In such an event, the pump-ready treatment fluid may also be called a pump-ready treatment fluid precursor. In some further embodiments, the pump-ready treatment fluid may be a fluid that is substantially ready to be pumped downhole except that certain incidental procedures are applied to the treatment fluid before pumping, such as low-speed agitation, heating or cooling under exceptionally cold or hot climate, etc.

In certain embodiments herein, for example in gravel packing, fracturing and frac-and-pack operations, the STS comprises proppant and a fluid phase at a volumetric ratio of the fluid phase (Vfluid) to the proppant (Vprop) equal to or less than 3. In embodiments, Vfluid/Vprop is equal to or less than 2.5. In embodiments, Vfluid/Vprop is equal to or less than 2. In embodiments, Vfluid/Vprop is equal to or less than 1.5. In embodiments, Vfluid/Vprop is equal to or less than 1.25. In embodiments, Vfluid/Vprop is equal to or less than 1. In embodiments, Vfluid/Vprop is equal to or less than 0.75. In embodiments, Vfluid/Vprop is equal to or less than 0.7. In embodiments, Vfluid/Vprop is equal to or less than 0.6. In embodiments, Vfluid/Vprop is equal to or less than 0.5. In embodiments, Vfluid/Vprop is equal to or less than 0.4. In embodiments, Vfluid/Vprop is equal to or less than 0.35. In embodiments, Vfluid/Vprop is equal to or less than 0.3. In embodiments, Vfluid/Vprop is equal to or less than 0.25. In embodiments, Vfluid/Vprop is equal to or less than 0.2. In embodiments, Vfluid/Vprop is equal to or less than 0.1. In embodiments, Vfluid/Vprop may be sufficiently high such that the STS is flowable. In some embodiments, the ratio $V_{fluid}/V_{prop}$ is equal to or greater than 0.05, equal to or greater than 0.1, equal to or greater than 0.15, equal to or greater than 0.2, equal to or greater than 0.25, equal to or greater than 0.3, equal to or greater than 0.35, equal to or greater than 0.4, equal to or greater than 0.5, or equal to or greater than 0.6, or within a range from any lower limit to any higher upper limit mentioned above.

Nota bene, the STS may optionally comprise subproppant particles in the whole fluid which are not reflected in the Vfluid/Vprop ratio, which is merely a ratio of the liquid phase (sans solids) volume to the proppant volume. This ratio is useful, in the context of the STS where the liquid phase is aqueous, as the ratio of water to proppant, i.e., Vwater/Vprop. In contrast, the "ppa" designation refers to pounds proppant added per gallon of base fluid (liquid plus subproppant particles), which can be converted to an equivalent volume of proppant added per volume of base fluid if the specific gravity of the proppant is known, e.g., 2.65 in the case of quartz sand embodiments, in which case 1 ppa=0.12 kg/L=45 mL/L; whereas "ppg" (pounds of proppant per gallon of treatment fluid) and "ppt" (pounds of additive per thousand gallons of treatment fluid) are based on the volume of the treatment fluid (liquid plus proppant and subproppant particles), which for quartz sand embodiments (specific gravity=2.65) also convert to 1 ppg=1000 ppt=0.12 kg/L=45 mL/L. The ppa, ppg and ppt nomenclature and their metric or SI equivalents are useful for considering the weight ratios of proppant or other additive(s) to base fluid (water or other fluid and subproppant) and/or to treatment fluid (water or other fluid plus proppant plus subproppant). The ppt nomenclature is generally used in embodiments reference to the concentration by weight of low concentration additives other than proppant, e.g., 1 ppt=0.12 g/L.

In embodiments, the proppant-containing treatment fluid comprises 0.27 L or more of proppant volume per liter of treatment fluid (corresponding to 720 g/L (6 ppg) in embodiments where the proppant has a specific gravity of 2.65), or 0.36 L or more of proppant volume per liter of treatment fluid (corresponding to 960 g/L (8 ppg) in embodiments where the proppant has a specific gravity of 2.65), or 0.4 L or more of proppant volume per liter of treatment fluid (corresponding to 1.08 kg/L (9 ppg) in embodiments where the proppant has a specific gravity of 2.65), or 0.44 L or more of proppant volume per liter of treatment fluid (corresponding to 1.2 kg/L (10 ppg) in embodiments where the proppant has a specific gravity of 2.65), or 0.53 L or more of proppant volume per liter of treatment fluid (corresponding to 1.44 kg/L (12 ppg) in embodiments where the proppant has a specific gravity of 2.65), or 0.58 L or more of proppant volume per liter of treatment fluid (corresponding to 1.56 kg/L (13 ppg) in embodiments where the proppant has a specific gravity of 2.65), or 0.62 L or more of proppant volume per liter of treatment fluid (corresponding to 1.68 kg/L (14 ppg) in embodiments where the proppant has a specific gravity of 2.65), or 0.67 L or more of proppant volume per liter of treatment fluid (corresponding to 1.8 kg/L (15 ppg) in embodiments where the proppant has a specific gravity of 2.65), or 0.71 L or more of proppant volume per liter of treatment fluid (corresponding to 1.92 kg/L (16 ppg) in embodiments where the proppant has a specific gravity of 2.65).

As used herein, in some embodiments, "high proppant loading" means, on a mass basis, more than 1.0 kg proppant added per liter of whole fluid including any sub-proppant particles (8 ppa), or on a volumetric basis, more than 0.36 L proppant added per liter of whole fluid including any sub-proppant particles, or a combination thereof. In some embodiments, the treatment fluid comprises more than 1.1 kg proppant added per liter of whole fluid including any sub-proppant particles (9 ppa), or more than 1.2 kg proppant added per liter of whole fluid including any sub-proppant particles (10 ppa), or more than 1.44 kg proppant added per liter of whole fluid including any sub-proppant particles (12 ppa), or more than 1.68 kg proppant added per liter of whole fluid including any sub-proppant particles (14 ppa), or more than 1.92 kg proppant added per liter of whole fluid including any sub-proppant particles (16 ppa), or more than 2.4 kg proppant added per liter of fluid including any sub-proppant particles (20 ppa), or more than 2.9 kg proppant added per liter of fluid including any sub-proppant particles (24 ppa). In some embodiments, the treatment fluid comprises more than 0.45 L proppant added per liter of whole fluid including any sub-proppant particles, or more than 0.54 L proppant added per liter of whole fluid including any sub-proppant particles, or more than 0.63 L proppant added per liter of whole fluid including any sub-proppant particles, or more than 0.72 L proppant added per liter of whole fluid including any sub-proppant particles, or more than 0.9 L proppant added per liter of whole fluid including any sub-proppant particles.

In some embodiments, the water content in the fracture treatment fluid formulation is low, e.g., less than 30% by volume of the treatment fluid, the low water content enables low overall water volume to be used, relative to a slickwater fracture job for example, to place a similar amount of proppant or other solids, with low to essentially zero fluid infiltration into the formation matrix and/or with low to zero flowback after the treatment, and less chance for fluid to enter the aquifers and other intervals. The low flowback leads to less delay in producing the stimulated formation, which can be placed into production with a shortened clean up stage or in some cases immediately without a separate flowback recovery operation.

In embodiments where the fracturing treatment fluid also has a low viscosity and a relatively high SVF, e.g., 40, 50, 60 or 70% or more, the fluid can in some surprising embodiments be very flowable (low viscosity) and can be pumped using standard well treatment equipment. With a high volumetric ratio of proppant to water, e.g., greater than about 1.0, these embodiments represent a breakthrough in water efficiency in fracture treatments. Embodiments of a low water content in the treatment fluid certainly results in correspondingly low fluid volumes to infiltrate the formation, and importantly, no or minimal flowback during fracture cleanup and when placed in production. In the solid pack, as well as on formation surfaces and in the formation matrix, water can be retained due to a capillary and/or surface wetting effect. In embodiments, the solids pack obtained from an STS with multimodal solids can retain a larger proportion of water than conventional proppant packs, further reducing the amount of water flowback. In some embodiments, the water retention capability of the fracture-formation system can match or exceed the amount of water injected into the formation, and there may thus be no or very little water flowback when the well is placed in production.

In some specific embodiments, the proppant laden treatment fluid comprises an excess of a low viscosity continuous fluid phase, e.g., a liquid phase, and a multimodal particle phase, e.g. solids phase, comprising high proppant loading with one or more proppant modes for fracture conductivity and at least one sub-proppant mode to facilitate proppant injection. As used herein an excess of the continuous fluid phase implies that the fluid volume fraction in a slurry (1-SVF) exceeds the void volume fraction (1-PVF) of the solids in the slurry, i.e., SVF<PVF. Solids in the slurry in embodiments may comprise both proppant and one or more sub-proppant particle modes. In embodiments, the continuous fluid phase is a liquid phase.

In some embodiments, the STS is prepared by combining the proppant and a fluid phase having a viscosity less than 300 mPa-s (170 $s^{-1}$, 25 C) to form the proppant-containing treatment fluid, and stabilizing the proppant-containing treatment fluid. Stabilizing the treatment fluid is described above. In some embodiments, the proppant-containing treatment fluid is prepared to comprise a viscosity between 0.1 and 300 mPa-s (170 $s^{-1}$, 25 C) and a yield stress between 1 and 20 Pa (2.1-42 $lb_f/ft^2$). In some embodiments, the proppant-containing treatment fluid comprises 0.36 L or more of proppant volume per liter of proppant-containing treatment fluid (8 ppa proppant equivalent where the proppant has a specific gravity of 2.6), a viscosity between 0.1 and 300 mPa-s (170 $s^{-1}$, 25 C), a solids phase having a packed volume fraction (PVF) greater than 0.72, a slurry solids volume fraction (SVF) less than the PVF and a ratio of SVF/PVF greater than about 1−2.1*(PVF−0.72).

In some embodiments, e.g., for delivery of a fracturing stage, the STS comprises a volumetric proppant/treatment fluid ratio (including proppant and sub-proppant solids) in a main stage of at least 0.27 L/L (6 ppg at sp.gr. 2.65), or at least 0.36 L/L (8 ppg), or at least 0.44 L/L (10 ppg), or at least 0.53 L/L (12 ppg), or at least 0.58 L/L (13 ppg), or at least 0.62 L/L (14 ppg), or at least 0.67 L/L (15 ppg), or at least 0.71 L/L (16 ppg).

In some embodiments, the injection of the treatment fluid of the current application can be reduced or stopped all together (i.e. at an injection rate of 0 bbl/min). Due to the excellent stability of the treatment fluid, very little or no proppant settling occurs during the period of 0 bbl/min injection. Well intervention, treatment monitoring, equipment adjustment, etc. can be carried out by the operator during this period of time. The pumping can be resumed thereafter.

Accordingly, the present invention provides the following embodiments:

1. A downhole tool positioning system, comprising:
   - a wellbore;
   - a slurry disposed within the wellbore;
   - a substantially buoyant tool disposed at least partially within the slurry;
   - a slurry circulation control system to move the slurry in the wellbore, wherein the tool is movable with the slurry to control positioning of the tool in the wellbore by controlled circulation of the slurry.

2. The system of embodiment 1, wherein the slurry has a specific gravity of at least 1.5, 2.0, 2.5, 3.0, 3.5, 4.0, 4.5, 5.0, 5.5, 6.0, 6.5, 7.0, 7.5, 8.0, 8.5, 9.0, 9.5, 10.0, 10.5, 11.0, 11.5, 12.0, 12.5, 13.0, 13.5, 14.0, 14.5, 15.0, 15.5, 16.0, 16.5, 17.0, 17.5 or 18.0, and is stabilized to meet at least one of the following conditions:
   - (1) the slurry has a low-shear viscosity equal to or greater than 1 Pa-s (5.11 $s^{-1}$, 25° C.);
   - (2) the slurry has a Herschel-Buckley (including Bingham plastic) yield stress (as determined in the manner described herein) equal to or greater than 1 Pa; or
   - (3) the largest particle mode in the slurry has a static settling rate less than 0.01 mm/hr; or
   - (4) the depth of any free fluid at the end of a 72-hour static settling test condition or an 8 h@15 Hz/10 d-static dynamic settling test condition (4 hours vibration followed by 20 hours static followed by 4 hours vibration followed finally by 10 days of static conditions) is no more than 2% of total depth; or
   - (5) the apparent dynamic viscosity (25° C., 170 $s^{-1}$) across column strata after the 72-hour static settling test condition or the 8 h@15 Hz/10 d-static dynamic settling test condition is no more than +/−20% of the initial dynamic viscosity; or
   - (6) the slurry solids volume fraction (SVF) across the column strata below any free water layer after the 72-hour static settling test condition or the 8 h@15 Hz/10 d-static dynamic settling test condition is no more than 5% greater than the initial SVF; or
   - (7) the density across the column strata below any free water layer after the 72-hour static settling test condition or the 8 h@15 Hz/10 d-static dynamic settling test condition is no more than 1% of the initial density.

3. The system of embodiment 1 or 2, wherein the slurry comprises a low-shear viscosity equal to or greater than 1 Pa-s (5.11 s−1, 25° C.) and a yield stress between 1 and 20 Pa (2.1-42 $lb_f/ft^2$).

4. The system of embodiment 1, 2 or 3, wherein the slurry comprises a low-shear viscosity equal to or greater than 1 Pa-s (5.11 s−1, 25° C.), a solids phase having a packed volume fraction (PVF) greater than 0.72, a slurry solids volume fraction (SVF) less than the PVF and a ratio of SVF/PVF greater than about 1−2.1*(PVF−0.72).

5. The system of any one of embodiments 1 to 4, wherein the slurry comprises a fluid loss control agent.

6. The system of any one of embodiments 1 to 5, wherein the wellbore comprises a vertical section in communication from the surface to at least one lateral, wherein the substantially buoyant tool is moveable in the lateral via the slurry circulation control system.

7. The system of any one of embodiments 1 to 6, further comprising a string connected to the tool, wherein the string comprises a pipe or tubing.

8. The system of embodiment 7, wherein the string has neutral buoyancy adjacent the tool.

9. The system of any one of embodiments 1 to 8, further comprising a wireline assembly connected to the tool.

10. The system of embodiment 9, wherein the wireline assembly has neutral buoyancy adjacent the tool.

11. The system of any one of embodiments 1 to 10, wherein the substantially buoyant tool has a positive or negative buoyancy less than 15%, or less than 10%, or less than 5%, or less than 2%, or less than 1%, or less than 0.5%, or less than 0.1%, of the displacement of the tool.

12. The system of any one of embodiments 1 to 11, wherein the tool comprises a buoyancy adjustment system to increase or decrease displacement of the tool.

13. The system of any one of embodiments 1 to 12, further comprising a slurry mixer to adjust the density of the slurry.

14. The system of any one of embodiments 1 to 13, further comprising a fluid control system to supply to or remove one or more fluids from the wellbore, or a combination thereof, wherein the one or more fluids comprise at least the slurry.

15. The system of embodiment 14, wherein the fluid control system comprises a first fluid flow path into a first cylinder adjacent a posterior end of the tool, a second fluid flow path into a second cylinder adjacent an anterior end of the tool, and a fluid controller to match a fluid volume increase in one of the first or second cylinders with a corresponding fluid volume decrease in the other one of the first or second cylinders.

16. The system of embodiment 14 or 15, wherein the first cylinder comprises an annulus between an inner surface of the wellbore and a pipe or coiled tubing string, the second cylinder comprises a portion of the wellbore between the anterior end of the tool and a well closure below the tool, and the second flow path comprises a central passage through the pipe or coiled tubing string.

17. The system of any one of embodiments 1 to 16, wherein the tool comprises a wiper to form a fluid seal with a surface of the wellbore.

18. The system of any one of embodiments 1 to 17, wherein the tool comprises a tractor.

19. The system of any one of embodiments 1 to 18, wherein the wellbore comprises a vertical section in communication from the surface to at least one lateral, wherein the substantially buoyant tool is moveable in the lateral via the slurry circulation control system, wherein the wellbore comprises first and second liquid columns in the wellbore, wherein the first liquid column comprises the slurry and the second liquid column comprises a relatively lighter fluid having a lower specific gravity than the slurry, and wherein the liquid columns are hydraulically connected at a managed interface to inhibit mixing between the slurry and the lighter fluid.

20. The system of embodiment 19, wherein the tool has a specific gravity less than the slurry and greater than the lighter fluid to maintain neutral buoyancy of the tool across the managed interface in the vertical section.

21. The system of embodiment 19 or 20, wherein the first liquid column is disposed in an annulus between a wall of the wellbore and an outer surface of a string connected to the tool.

22. The system of any one of embodiments 19 to 21, wherein the first liquid column is disposed in an annulus between a wall of the wellbore, wherein the slurry circulation control system comprises: a slurry reservoir connection for supplying slurry from the slurry reservoir to the annulus or returning slurry from the annulus to the slurry reservoir, a lighter fluid reservoir connection for supplying the lighter fluid from the lighter fluid reservoir to the string or returning lighter fluid from the string to the lighter fluid reservoir, or a combination thereof.

23. A method, comprising:

providing a treatment fluid for use with a downhole tool and optionally a string in a wellbore comprising a vertical section in communication from the surface to at least one lateral, wherein the downhole tool is moveable in the lateral;

providing the downhole tool and any string with a weight and displacement that closely matches the density of the treatment fluid, providing the treatment fluid with a density that closely matches the specific gravity of the downhole tool and any string, or a combination thereof, such that the downhole tool and any string are substantially buoyant in the treatment fluid; and flowing the treatment fluid in the wellbore to hydraulically translate the downhole tool in the wellbore.

24. The method of embodiment 23, further comprising preparing the treatment fluid by combining a carrier fluid and solids to form a slurry having a specific gravity of at least 1.4, 1.5, 1.6, 1.7, 1.8, 1.9, 2, 2.1 or 2.2, and stabilizing the slurry to inhibit solids settling, wherein the stabilized slurry has one or more of the following characteristics:

(1) the slurry has a low-shear viscosity equal to or greater than 1 Pa-s (5.11 $s^{-1}$, 25° C.);

(2) the slurry has a Herschel-Buckley (including Bingham plastic) yield stress (as determined in the manner described herein) equal to or greater than 1 Pa; or (3) the largest particle mode in the slurry has a static settling rate less than 0.01 mm/hr; or (4) the depth of any free fluid at the end of a 72-hour static settling test condition or an 8 h@15 Hz/10 d-static dynamic settling test condition (4 hours vibration followed by 20 hours static followed by 4 hours vibration followed finally by 10 days of static conditions) is no more than 2% of total depth; or (5) the apparent dynamic viscosity (25° C., 170 $s^{-1}$) across column strata after the 72-hour static settling test condition or the 8 h@15 Hz/10 d-static dynamic settling test condition is no more than +/−20% of the initial dynamic viscosity; or (6) the slurry solids volume fraction (SVF) across the column strata below any free water layer after the 72-hour static settling test condition or the 8 h@15 Hz/10 d-static dynamic settling test condition is no more than 5% greater than the initial SVF; or (7) the density across the column strata below any free water layer after the 72-hour static settling test condition or the 8 h@15 Hz/10 d-static dynamic settling test condition is no more than 1% of the initial density.

25. The method of embodiment 24, wherein:

(1). the depth of any free fluid at the end of the 8 h@15 Hz/10 d-static dynamic settling test condition is no more than 2% of total depth;

(2). the apparent dynamic viscosity (25° C., 170 s−1) across column strata after the 8 h@15 Hz/10 d-static dynamic settling test condition is no more than +/−20% of the initial dynamic viscosity;

(3). The slurry solids volume fraction (SVF) across the column strata below any free water layer after the 8 h@15 Hz/10 d-static dynamic settling test condition is no more than +/−5% of the initial SVF; and (4). The density across the column strata below any free water layer after the 8 h@15 Hz/10 d-static dynamic settling test condition is no more than 1% of the initial density.

26. The method of any one of embodiments 23 to 26, further comprising preparing the treatment fluid by combining a carrier fluid and solids to form a slurry having a specific gravity of at least 1.4, 1.5, 1.6, 1.7, 1.8, 1.9, 2, 2.1 or 2.2, and stabilizing the slurry to inhibit solids settling by at least one of: (1) introducing sufficient particles into the slurry or treatment fluid to increase the SVF of the treatment fluid to at least 0.4; (2) increasing a low-shear viscosity of the slurry or treatment fluid to at least 1 Pa-s (5.11 s−1, 25° C.); (3) increasing a yield stress of the slurry or treatment fluid to at least 1 Pa; (4) increasing apparent viscosity of the slurry or treatment fluid to at least 50 mPa-s (170 s−1, 25° C.); (5) introducing a multimodal solids phase into the slurry or treatment fluid; (6) introducing a solids phase having a PVF greater than 0.7 into the slurry or treatment fluid; (7) introducing into the slurry or treatment fluid a viscosifier selected from viscoelastic surfactants, e.g., in an amount ranging from 0.01 up to 7.2 g/L (60 ppt), and hydratable gelling agents, e.g., in an amount ranging from 0.01 up to 4.8 g/L (40 ppt) based on the volume of fluid phase; (8) introducing colloidal particles into the slurry or treatment fluid; (9) reducing a particle-fluid density delta to less than 1.6 g/mL (e.g., introducing particles having a specific gravity less than 2.65 g/mL, carrier fluid having a density greater than 1.05 g/mL or a combination thereof); (10) introducing particles into the slurry or treatment fluid having an aspect ratio of at least 6; (11) introducing ciliated or coated proppant into slurry or treatment fluid; and (12) combinations thereof.

27. The method of embodiment 26, wherein the slurry comprises a low-shear viscosity equal to or greater than 1 Pa-s (5.11 s−1, 25° C.) and a yield stress between 1 and 20 Pa (2.1-42 $lb_f/ft^2$).

28. The method of embodiment 26 or 27, wherein the slurry comprises a low-shear viscosity equal to or greater than 1 Pa-s (5.11 s−1, 25° C.), a solids phase having a packed volume fraction (PVF) greater than 0.72, a slurry solids volume fraction (SVF) less than the PVF and a ratio of SVF/PVF greater than about 1−2.1*(PVF−0.72).

29. The method of any one of embodiments 26 to 28, further comprising adding a fluid loss control agent to the slurry.

30. The method of any one of embodiments 23 to 29, further comprising operating the downhole tool to perforate the surface of the lateral into an adjacent subterranean formation.

31. The method of any one of embodiments 23 to 30, further comprising mechanically assisting the translation.

32. The method of any one of embodiments 23 to 31, further comprising operating a propeller or pump on the tool to induce fluid flow with respect to the tool.

33. The method of any one of embodiments 23 to 32, further comprising deploying a wiper to form a fluid seal between the tool and a surface of the lateral.

34. The method of any one of embodiments 23 to 33, further comprising anchoring the tool in the lateral.

35. The method of any one of embodiments 23 to 34, wherein the substantially buoyant tool has a positive or negative buoyancy less than 15%, or less than 10%, or less than 5%, or less than 2%, or less than 1%, or less than 0.5%, or less than 0.1%, of the displacement of the tool.

36. The method of any one of embodiments 23 to 35, further comprising adjusting the buoyancy of the downhole tool in the lateral.

37. The method of any one of embodiments 23 to 36, further comprising supplying to or removing one or more fluids from the wellbore, or a combination thereof to induce movement of the tool in the lateral.

38. The method of embodiment 37, further comprising changing a first fluid volume in a first cylinder adjacent a posterior end of the tool, changing a second fluid volume in a second cylinder adjacent an anterior end of the tool, and matching a fluid volume increase in one of the first or second cylinders with a corresponding fluid volume decrease in the other one of the first or second cylinders.

39. The method of embodiment 38, wherein the first cylinder comprises an annulus between an inner surface of the wellbore and a pipe or coiled tubing string, the second cylinder comprises a portion of the wellbore between the anterior end of the tool and a well closure below the tool, and changing the second fluid volume via a flow path comprising a central passage through a pipe or coiled tubing string connected to the tool.

40. A downhole tool positioning system, comprising:

a wellbore;

a slurry disposed within the wellbore;

a tool disposed at least partially within the slurry wherein the tool is substantially buoyant within the slurry;

a slurry control system to move the slurry in the wellbore and control positioning of the tool in the wellbore.

41. The system of embodiment 40, wherein the slurry has a specific gravity within +/−50% of that of the tool.

42. The system of embodiment 41, wherein the slurry has a specific gravity within +/−35% of that of the tool.

43. The system of embodiment 42, wherein the slurry has a specific gravity within +/−15% of that of the tool.

44. The system of embodiment 43, wherein the slurry has a specific gravity within +/−10% of that of the tool.

45. The system of embodiment 44, wherein the slurry has a specific gravity within +/−5% of that of the tool.

46. The system of embodiment 45, wherein the slurry has a specific gravity substantially the same as that of the tool.

47. The system of any of embodiments 40-46, wherein the slurry is stabilized to meet at least one of the following conditions:

(1) the slurry has a low-shear viscosity equal to or greater than 1 Pa-s (5.11 $s^{-1}$, 25° C.);

(2) the slurry has a Herschel-Buckley (including Bingham plastic) yield stress (as determined in the manner described herein) equal to or greater than 1 Pa; or (3) the largest particle mode in the slurry has a static settling rate less than 0.01 mm/hr; or (4) the depth of any free fluid at the end of a 72-hour static settling test condition or an 8 h@15 Hz/10 d-static dynamic settling test condition (4 hours vibration followed by 20 hours static followed by 4 hours vibration followed finally by 10 days of static conditions) is no more than 2% of total depth; or (5) the apparent dynamic viscosity (25° C., 170 $s^{-1}$) across column strata after the 72-hour static settling test condition or the 8 h@15 Hz/10 d-static dynamic settling test condition is no more than +/−20% of the initial dynamic viscosity; or (6) the slurry solids volume fraction (SVF) across the column strata below any free water layer after the 72-hour static settling test condition or the 8 h@15 Hz/10 d-static dynamic settling test condition is no more than 5% greater than the initial SVF; or (7) the density across the column strata below any free water layer after the 72-hour static settling test condition or the 8 h@15 Hz/10 d-static dynamic settling test condition is no more than 1% of the initial density.

48. The system of any of embodiments 40-47, wherein the slurry comprises a low-shear viscosity equal to or greater than 1 Pa-s (5.11 s−1, 25° C.) and a yield stress between 1 and 20 Pa (2.1-42 $lb_f/ft^2$).

49. The system of any of embodiments 40-48, wherein the slurry comprises a low-shear viscosity equal to or greater than 1 Pa-s (5.11 s−1, 25° C.), a solids phase having a packed volume fraction (PVF) greater than 0.72, a slurry solids volume fraction (SVF) less than the PVF and a ratio of SVF/PVF greater than about 1−2.1*(PVF−0.72).

50. The system of any of embodiments 40-49, wherein the wellbore comprises a vertical section in communication from the surface to at least one lateral, wherein the substantially buoyant tool is moveable in the lateral via the slurry control system.

51. The system of any of embodiments 40-50, wherein the fluid control system comprises a first fluid flow path into a first cylinder adjacent a posterior end of the tool, a second fluid flow path into a second cylinder adjacent an anterior end of the tool, and a fluid controller to match a fluid volume increase in one of the first or second cylinders with a corresponding fluid volume decrease in the other one of the first or second cylinders.

52. The system of any of embodiments 40-51, wherein the first cylinder comprises an annulus between an inner surface of the wellbore and a pipe or coiled tubing string, the second cylinder comprises a portion of the wellbore between the anterior end of the tool and a well closure below the tool, and the second flow path comprises a central passage through the pipe or coiled tubing string.

53. The system of any of embodiments 40-52, wherein the tool comprises a wiper to form a fluid seal with a surface of the wellbore.

54. The system of any of embodiments 40-53, further comprising a tractor to facilitate the positioning of the tool in the wellbore.

55. The system of any of embodiments 40-54, wherein the wellbore comprises a vertical section in communication from the surface to at least one lateral, wherein the substantially buoyant tool is moveable in the lateral via the slurry control system, wherein the wellbore comprises first and second liquid columns in the wellbore, wherein the first liquid column comprises the slurry and the second liquid column comprises a relatively lighter fluid having a lower specific gravity than the slurry, and wherein the liquid columns are hydraulically connected at a managed interface to inhibit mixing between the slurry and the lighter fluid.

56. The system of any of embodiments 40-55, wherein the tool has a specific gravity less than the slurry and greater than the lighter fluid to maintain neutral buoyancy of the tool across the managed interface in the vertical section.

57. The system of any of embodiments 40-56, wherein the first liquid column is disposed in an annulus between a wall of the wellbore and an outer surface of a string connected to the tool.

58. The system of any of embodiments 40-57, wherein the first liquid column is disposed in an annulus between a wall of the wellbore, wherein the slurry control system comprises: a slurry reservoir connection for supplying slurry from the slurry reservoir to the annulus or returning slurry from the annulus to the slurry reservoir, a lighter fluid reservoir connection for supplying the lighter fluid from the lighter fluid reservoir to the string or returning lighter fluid from the string to the lighter fluid reservoir, or a combination thereof.

59. A method, comprising:

determining weight and displacement of a downhole tool for use in a wellbore comprising a vertical section in communication from the surface to at least one lateral, wherein the downhole tool is moveable in the lateral;

providing a treatment fluid having a density that closely match that of the downhole tool such that the downhole tool is substantially buoyant in the treatment fluid;

flowing the treatment fluid in the wellbore to hydraulically translate the downhole tool in the wellbore.

60. The system of embodiment 59, wherein the slurry has a specific gravity within +/−50% of that of the tool.

61. The system of embodiment 60, wherein the slurry has a specific gravity within +/−15% of that of the tool.

62. The system of embodiment 61, wherein the slurry has a specific gravity within +/−5% of that of the tool.

63. The system of embodiment 62, wherein the slurry has a specific gravity substantially the same as that of the tool.

64. The method of any of embodiments 59-63, further comprising stabilizing the slurry to inhibit solids settling.

65. The method of any of embodiments 59-64, further comprising deploying a wiper to form a fluid seal between the tool and a surface of the lateral.

66. The method of any of embodiments 59-65, further comprising supplying to or removing one or more fluids from the wellbore, or a combination thereof to induce movement of the tool in the lateral.

67. The system or method of any preceding embodiment, wherein the slurry has a specific gravity of at least 1.5, 2.0, 2.5, 3.0, 3.5, 4.0, 4.5, 5.0, 5.5, 6.0, 6.5, 7.0, 7.5, 8.0, 8.5, 9.0, 9.5, 10.0, 10.5, 11.0, 11.5, 12.0, 12.5, 13.0, 13.5, 14.0, 14.5, 15.0, 15.5, 16.0, 16.5, 17.0, 17.5 or 18.0.

68. The system or method of any preceding embodiment, wherein the slurry has a specific gravity of at least 4.0.

69. The system or method of any preceding embodiment, wherein the slurry has a specific gravity of at least 6.0.

70. The system or method of any preceding embodiment, wherein the slurry has a specific gravity of at least 7.0.

71. The system or method of any preceding embodiment, wherein the slurry has a specific gravity of about 7.8.

EXAMPLES

Example 1

Stabilized Treatment Slurry

An example of a stabilized treatment slurry (STS) is provided in Table 1 below.

TABLE 1

STS Composition.

| Fluid components | StabilizedProppant Free Slurry (g/L of STS) | Stabilized Proppant/ Solids Slurry (g/L of STS) |
|---|---|---|
| Crystalline silica 40/70 mesh | 0 | 900-1100 |
| Crystalline silica 100 mesh | 0 | 125-225 |
| Crystalline silica 400 mesh | 600-800 | 100-250 |
| Calcium Carbonate[1] 2 micron | 300-400 | 175-275 |
| Water | 150-250 | 150-250 |
| Latex[2] | 300-500 | 100-300 |

TABLE 1-continued

| STS Composition. | | |
|---|---|---|
| Fluid components | StabilizedProppant Free Slurry (g/L of STS) | Stabilized Proppant/ Solids Slurry (g/L of STS) |
| Dispersant[3] | 2-4 | 2-4 |
| Antifoam[4] | 3-5 | 1-3 |
| Viscosifier[5] | 6-10 | 6-10 |

[1]Calcium Carbonate = SAFECARB 2 from MI-SWACO
[2]Latex = Styrene-Butadiene copolymer dispersion
[3]Dispersant = Polynaphthalene sulfonate
[4]Antifoam = Silicone emulsion
[5]Viscosifier = AMPS/acrylamide copolymer solution Excellent particle (proppant) suspension capability and very low fluid loss were observed. The fluid leak off coefficient was determined by following the static fluid loss test and procedures set forth in Section 8-8.1, "Fluid loss under static conditions," in *Reservoir Stimulation,* 3rd Edition, Schlumberger, John Wiley & Sons, Ltd., pp. 8-23 to 8-24, 2000, in a filter-press cell using ceramic disks (FANN filter disks, part number 210538) saturated with 2% KCl solution and covered with filter paper, and test conditions of ambient temperature (25° C.), a differential pressure of 3.45 MPs (500 psi) and a loss collection period of 60 minutes, or an equivalent test. The results are shown in FIG. 12. The total leak off coefficient of STS was determined to be very low from the test. The STS fluid loss did not appear to be a function of differential pressure. This unique low to no fluid loss property, and excellent stability (low rate of solids settling), allows the STS to be pumped at a low rate without concern of screen out.

Example 2

STS Slurry Stability Tests

A slurry sample was prepared with the formulation given in Table 2.

TABLE 2

| STS Composition | |
|---|---|
| Components | g/L Slurry |
| 40/70 proppant | 700-800 |
| 100 mesh sand | 100-150 |
| 30μ silica | 100-140 |
| 2μ CaCO3 (SafeCARB2) | 150-200 |
| 0.036 wt % Diutan solution | 0.4-0.6 |
| Water and other additives | 250-350 |

The slurry was prepared by mixing the water, diutan and other additives, and SafeCARB particles in two 37.9-L (10 gallon) batches, one in an eductor and one in a RUSHTON turbine, the two batches were combined in a mortar mixer and mixed for one minute. Then the sand was added and mixed one minute, silica added and mixed with all components for one minute. A sample of the freshly prepared slurry was evaluated in a Fann 35 rheometer at 25° C. with an R1B5F1 configuration at the beginning of the test with speed ramped up to 300 rpm and back down to 0, an average of the two readings at 3, 6, 100, 200 and 300 rpm (2.55, 5.10, 85.0, 170 and 255 $s^{-1}$) recorded as the shear stress, and the yield stress ($\tau_0$) determined as the y-intercept using the Herschel-Buckley rheological model.

The slurry was then placed and sealed with plastic in a 152 mm (6 in.) diameter vertical gravitational settling column filled with the slurry to a depth of 2.13 m (7 ft). The column was provided with 25.4-mm (1 in.) sampling ports located on the settling column at 190 mm (6'3"), 140 mm (4'7"), 84 mm (2'9") and 33 mm (1'1") connected to clamped tubing. The settling column was mounted with a shaker on a platform isolated with four airbag supports. The shaker was a BUTTKICKER brand low frequency audio transducer. The column was vibrated at 15 Hz with a 1 mm amplitude (vertical displacement) for two 4-hour periods the first and second settling days, and thereafter maintained in a static condition for 10 days (12 days total settling time, hereinafter "8 h@15 Hz/10 d static"). The 15 Hz/1 mm amplitude condition was selected to correspond to surface transportation and/or storage conditions prior to the well treatment.

At the end of the settling period the depth of any free water at the top of the column was measured, and samples were obtained, in order from the top sampling port down to the bottom. The post-settling period samples were similarly evaluated in the rheometer under the same configuration and conditions as the initial slurry, and the Herschel-Buckley yield stress calculated. The results are presented in Table 3.

TABLE 3

| Rheological properties, initial and 8 h@15 Hz/10 d Dynamic-static aged samples | | | | | |
|---|---|---|---|---|---|
| | Shear Rate ($s^{-1}$): | | | | |
| | 2.55 | 5.1 | 85 | 170 | Delta, @ 170 $s^{-1}$ (%) |
| Shear Stress (Pa (lbf/100 ft2)) | | | | | |
| Initial slurry | 17.9 (37.4) | 21.3 (44.5) | 84.5 (176.4) | 135 (282.7) | (base line) |
| Aged slurry, 8 h@15 Hz/10 d static | | | | | |
| Top sample | 15.4 (32.1) | 19.3 (40.4) | 76.8 (160.3) | 123 (257.1) | −8.9 |
| Upper middle sample | 15.9 (33.3) | 20.2 (42.2) | 81.9 (171) | 132 (276.1) | −2.3 |
| Lower middle sample | 14.8 (30.9) | 19.3 (40.4) | 79.3 (165.7) | 130 (271.4) | −3.7 |
| Bottom sample | 18.6 (38.9) | 22.7 (47.5) | 89.6 (187.1) | 146 (305.8) | +8.1 |

Since the slurry showed no or low free water depth after aging, the apparent viscosities (taken as the shear rate) of the aged samples were all within 9% of the initial slurry, the slurry was considered stable. Since none of the samples had an apparent viscosity (calculated as shear rate/shear stress) greater than 300 mPa-s, the slurry was considered readily flowable. The carrier fluid was deionized water. Slurries were prepared by mixing the solids mixture and the carrier fluid. The slurry samples were screened for mixability and the depth of any free water formed before and after allowing the slurry to settle for 72 hours at static conditions. Samples which could not be mixed using the procedure described were considered as not mixable. The samples in which more than 5% free water formed were considered to be excessively settling slurries. The results were plotted in the diagram seen in FIG. 7.

From the data seen in FIG. 16, stable, mixable slurries were generally obtained where PVF is about 0.71 or more, the ratio of SVF/PVF is greater than 2.1*(PVF−0.71), and, where PVF is greater than about 0.81, SVF/PVF is less than 1−2.1*(PVF−0.81). These STS systems were obtained with a low carrier fluid viscosity without any yield stress. By increasing the viscosity of the carrier fluid and/or using a yield stress fluid, an STS may be obtained in some embodiments with a lower PVF and/or a with an SVF/PVF ratio less than 1−2.1*(PVF−0.71).

Examples 3-6

Additional Formulations

Additional STS formulations were prepared as shown in Table 4. Example 3 was prepared without proppant and exemplifies a high-solids stabilized slurry without proppant that can be used as a motive treatment fluid for downhole tools, e.g., as a spacer fluid, pad or managed interface fluid associated with the conveyance of the downhole tool or otherwise, to precede or follow a proppant-containing treatment fluid. Example 4 was similar to Example 5 except that it contained proppant including 100 mesh sand. Example 5 was prepared with gelling agent instead of latex. Example 6 was similar to Example 5, but was prepared with dispersed oil particles instead of calcium carbonate. Examples 3-6 exemplify treatment fluids suitable for conveying downhole tools in a wellbore as well as fracturing low mobility formations.

All of the fluids were stable, and had a yield point above 10 Pa and a viscosity less than 10 Pa-s. Rehological, leak-off control and other fluid properties are given in Table 6.

Example 7

Formulation Gravity Adjustment

Additional formulations are prepared with different solid materials and carrier liquids having different specific gravities to adjust the specific gravity of the treatment fluid to match the density of the downhole tool for neutral buoyancy as needed. The formulations have the compositions as shown in Table 5, but may also optionally include a particle size distribution and/or anti-settling agents or gelling agents such as guar, diutan, xanthan, etc. as needed for suitable fluid stability. Solids may be based, for example, on silica (sg 2.65), hematite (sg 4.8-6), silver (sg 10.5), thorium (sg 11.7), rhodium (sg 12.41), tantalum (sg 16.7), tungsten (sg 19.3), osmium (sg 22.57), etc. Carrier liquids may be based on water (sg 1.0), brine (sg 1-2.4), methylene iodide (sg 3.3), mercury (sg 13.54), etc.

TABLE 4

STS Composition and Properties

| | Size (μm) | STS Example 3 Wt % | Example 4 Wt % | Example 5 Wt % | Example 6 Wt % |
|---|---|---|---|---|---|
| Components | | | | | |
| 40/70 proppant | 210-400 | — | 50-55 | 50-55 | 50-55 |
| 100 mesh sand | 150 | — | 8-12 | 8-12 | 8-12 |
| Silica flour | 28-33 | 40-45 | 6-12 | 6-12 | 6-12 |
| CaCO3 | 2.5-3 | 20-25 | 8-12 | 8-12 | — |
| Liquid Latex | 0.18 | 20-25 | 8-12 | — | — |
| Viscosifier | — | 0.1-1 | 0.1-1 | — | — |
| Anti-foam | — | 0.05-0.5 | 0.05-0.5 | — | — |
| Gelling agent | — | — | — | 0.01-0.05 | 0.01-0.05 |
| Dispersant | — | 0.05-0.5 | 0.05-0.5 | 0.05-0.5 | — |
| Breaker | — | — | — | 0.01-0.1 | 0.01-0.1 |
| Breaker aid | — | — | — | 0.005-0.05 | 0.005-0.05 |
| Oil | — | — | — | — | 2-3 |
| Surfactant | — | — | — | — | 0.1-1 |
| Water | — | 8-12 | 8-12 | 18-22 | 18-22 |
| Rheology | | | | | |
| Yield Point (Pa) | | 11.5 | 8.9 | 15.3 | 13.5 |
| K (Pa-s$^n$) | | 5.41 | 3.09 | 1.42 | 2.39 |
| n | | 0.876 | 0.738 | 0.856 | 0.725 |
| Stability (static 72 h) | | Stable | Stable | Stable | Stable |
| Leak off control | | | | | |
| Cw (ft/min$^{1/2}$) | | 0.0002 | 0.00015 | 0.003 | 0.0014 |
| Filter cake (mm) | | ~1 | <1 | ~5 | ~5 |
| Clean up permeability (D) | | ND | ND | 0.004-0.024 | 1-1.2 |
| Fluid Properties | | | | | |
| SVF (%) | | 40 (60*) | 60 (70*) | 60 | 54 (60*) |
| Specific gravity | | 1.68 | 2 | 2 | 1.88 |
| PPA (whole fluid) | | NA | 14 | 14 | 13.6 |

Notes:
ND = not determined
NA = not applicable
*= including latex or oil

TABLE 7

| Conveying Fluid Specific Gravity Variations | | | | | | |
|---|---|---|---|---|---|---|
| | Specific Gravity | | | | | |
| FLUID Comp.: | Solid A | Solid B | Solid C | Solid D | Carrier Liquid | Treatment Fluid |
| Size (μm) | 210-400 | 150 | 28-33 | 2-3 | Liquid | Slurry |
| Wt % | 50-55 | 8-12 | 6-12 | 8-12 | 18-22 | 100 |
| TF-1 | 2.65 | 2.65 | 2.65 | 2.65 | 1.0 | 1.99 |
| TF-2 | 2.65 | 2.65 | 2.65 | 2.71 | 1.0 | 2.0 |
| TF-3 | 2.65 | 2.65 | 2.65 | 4.8 | 1.0 | 2.17 |
| TF-4 | 2.65 | 2.65 | 4.8 | 4.8 | 1.0 | 2.3 |
| TF-5 | 4.8 | 2.65 | 2.65 | 2.65 | 1.0 | 2.83 |
| TF-6 | 4.8 | 4.8 | 4.8 | 4.8 | 1.0 | 3.28 |
| TF-7 | 6 | 6 | 6 | 6 | 1.0 | 4.0 |
| TF-8 | 2.65 | 2.65 | 2.65 | 2.65 | 1.5 | 2.19 |
| TF-9 | 2.65 | 2.65 | 2.65 | 2.71 | 2 | 2.39 |
| TF-10 | 2.65 | 2.65 | 2.65 | 4.8 | 2.4 | 2.55 |
| TF-11 | 2.65 | 2.65 | 4.8 | 4.8 | 1.5 | 3.03 |
| TF-12 | 4.8 | 2.65 | 2.65 | 2.65 | 2.4 | 3.39 |
| TF-13 | 4.8 | 4.8 | 4.8 | 4.8 | 2.4 | 3.84 |
| TF-14 | 6 | 6 | 6 | 6 | 2.4 | 4.56 |
| TF-15 | 4 | 4 | 4 | 4 | 3.3 | 3.7 |
| TF-16 | 10.5 | 10.5 | 10.5 | 10.5 | 2.4 | 7.26 |
| TF-17 | 11.7 | 11.7 | 11.7 | 11.7 | 2.4 | 7.98 |
| TF-18 | 12.4 | 12.4 | 12.4 | 12.4 | 2.4 | 8.41 |
| TF-19 | 16.7 | 16.7 | 16.7 | 16.7 | 2.4 | 10.98 |
| TF-20 | 19.3 | 19.3 | 19.3 | 19.3 | 2.4 | 12.54 |
| TF-21 | 19.3 | 19.3 | 19.3 | 19.3 | 13.54 | 17.0 |
| TF-22 | 22.57 | 22.57 | 22.57 | 22.57 | 13.54 | 18.96 |

While the disclosure has provided specific and detailed descriptions to various embodiments, the same is to be considered as illustrative and not restrictive in character. Only certain example embodiments have been shown and described. Those skilled in the art will appreciate that many modifications are possible in the example embodiments without materially departing from the disclosure. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary. In the claims, means-plus-function clauses are intended to cover the structures described herein as performing the recited function and not only structural equivalents, but also equivalent structures. For example, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

We claim:

1. A downhole tool positioning system, comprising:

a wellbore;

a slurry disposed within the wellbore;

a tool optionally connected to a string in the wellbore and disposed at least partially within the slurry;

a specific gravity balance between the slurry and the tool, the string or a combination thereof, wherein the tool and the string are substantially buoyant within the slurry; and a slurry control system to move the slurry in the wellbore and control positioning of the tool in the wellbore, wherein the buoyancy of the tool and the properties of the slurry are adjustable during positioning of the tool.

2. The system of claim 1, wherein the tool is connected to the string comprising a wireline.

3. The system of claim 1, wherein the tool is connected to the string comprising tubing.

4. The system of claim 1, wherein the slurry has a specific gravity within about 50% of that of the tool and the string.

5. The system of claim 4, wherein the slurry has a specific gravity within about 10% of that of the tool.

6. The system of claim 1, wherein the slurry has a specific gravity within about 35% of that of the tool and the string.

7. The system of claim 1, wherein the slurry has a specific gravity within about 15% of that of the tool and the string.

8. The system of claim 1, wherein the slurry is stabilized to meet at least one of the following conditions:

(1) the slurry has a low-shear viscosity equal to or greater than 1 Pa-s (5.11 s−1, 25° C.);

(2) the slurry has a Herschel-Buckley (including Bingham plastic) yield stress equal to or greater than 1 Pa; or (3) a largest particle mode in the slurry has a static settling rate less than 0.01 mm/hr; or (4) the depth of any free fluid at the end of a 72-hour static settling test condition or an 8 h@15 Hz/10d-static dynamic settling test condition (4 hours vibration followed by 20 hours static followed by 4 hours vibration followed finally by 10 days of static conditions) is no more than 2% of total depth; or (5) the apparent dynamic viscosity (25° C., 170 s−1) across column strata after the 72-hour static settling test condition or the 8 h@15 Hz/10d-static dynamic settling test condition is no more than about 20% of the initial dynamic viscosity; or (6) the slurry solids volume fraction (SVF) across the column strata below any free water layer after the 72-hour static settling test condition or the 8 h@15 Hz/10d-static dynamic settling test condition is no more than 5% greater than the initial SVF; or (7) the density across the column strata below any free water layer after the 72-hour static settling test condition or the 8 h@15 Hz/10d-static dynamic settling test condition is no more than 1% of the initial density.

9. The system of claim 1, wherein the slurry comprises a low-shear viscosity equal to or greater than 1 Pa-s (5.11 s−1, 25° C.) and a yield stress between 1 and 20 Pa (2.1-42 $lbf/ft^2$).

10. The system of claim 1, wherein the slurry comprises a low-shear viscosity equal to or greater than 1 Pa-s (5.11 s−1, 25° C.), a solids phase having a packed volume fraction (PVF) greater than 0.72, a slurry solids volume fraction (SVF) less than the PVF and a ratio of SVF/PVF greater than about (1-2.1*(PVF−0.72)).

11. The system of claim 1, wherein the wellbore comprises a vertical section in communication from the surface to at least one lateral, wherein the substantially buoyant tool is moveable in the lateral via the slurry control system.

12. The system of claim 1, wherein the slurry control system comprises a first fluid flow path into a first cylinder adjacent a posterior end of the tool, a second fluid flow path into a second cylinder adjacent an anterior end of the tool, and a fluid controller to match a fluid volume increase in one of the first or second cylinders with a corresponding fluid volume decrease in the other one of the first or second cylinders.

13. The system of claim 1, wherein the tool comprises a wiper to form a fluid seal with a surface of the wellbore.

14. The system of claim 1, further comprising a tractor to facilitate the positioning of the tool in the wellbore.

15. The system of claim 1, wherein the wellbore comprises a vertical section in communication from the surface to at least one lateral, wherein the substantially buoyant tool is moveable in the lateral via the slurry control system, wherein the wellbore comprises first and second liquid columns in the wellbore, wherein the first liquid column comprises the slurry and the second liquid column comprises a relatively lighter fluid having a lower specific gravity than the slurry, and wherein the liquid columns are hydraulically connected at a managed interface to inhibit mixing between the slurry and the lighter fluid.

16. The system of claim 15, wherein the tool has a specific gravity less than the slurry and greater than the lighter fluid to maintain neutral buoyancy of the tool across the managed interface in the vertical section.

17. A method, comprising:

providing a treatment fluid for use with a downhole tool and optionally a string in a wellbore comprising a vertical section in communication from the surface to at least one lateral, wherein the downhole tool is moveable in the lateral;

providing the downhole tool and the string with a weight and displacement that closely matches the density of the treatment fluid, providing the treatment fluid with a density that closely matches the specific gravity of the downhole tool and any string, or a combination thereof, such that the downhole tool and the string are substantially buoyant in the treatment fluid;

flowing the treatment fluid in the wellbore to hydraulically translate the downhole tool in the wellbore; and adjusting the weight or displacement of the tool to maintain substantial buoyancy of the tool in the treatment fluid during translation of the downhole tool.

18. The method of claim 17, comprising:

selecting the downhole tool and string;

determining the weight and displacement of the downhole tool and string;

providing the treatment fluid with the density that closely matches the specific gravity of the downhole tool and string; and adjusting the specific gravity of the treatment fluid to maintain substantial buoyancy of the tool in the treatment fluid during translation of the downhole tool.

19. The method of claim 17, comprising:

selecting the treatment fluid;

determining the density of the treatment fluid;

providing the downhole tool and string with the specific gravity that closely matches the treatment fluid; and adjusting the specific gravity of the treatment fluid to maintain substantial buoyancy of the tool in the treatment fluid during translation of the downhole tool.

20. The method of claim 17, further comprising recovering the treatment fluid and re-using the recovered treatment fluid in a subsequent hydraulic translation step.

* * * * *